US010330379B2

(12) United States Patent
Kim et al.

(10) Patent No.: US 10,330,379 B2
(45) Date of Patent: Jun. 25, 2019

(54) REFRIGERATOR AND METHOD OF CONTROLLING THE SAME

(71) Applicant: Samsung Electronics Co., Ltd., Suwon-si (KR)

(72) Inventors: Soo Kang Kim, Yongin-si (KR); Jung Won Park, Suwon-si (KR); Sung Ho Cho, Suwon-si (KR); Seung Wan Kang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/044,587

(22) Filed: Feb. 16, 2016

(65) Prior Publication Data

US 2016/0238310 A1 Aug. 18, 2016

(30) Foreign Application Priority Data

Feb. 17, 2015 (KR) ..... 10-2015-0024063

(51) Int. Cl.

| | |
|---|---|
| ***F25D 29/00*** | (2006.01) |
| ***F25D 31/00*** | (2006.01) |
| ***B01F 3/04*** | (2006.01) |
| ***F25D 23/12*** | (2006.01) |

(52) U.S. Cl.

CPC ..... *F25D 29/005* (2013.01); *B01F 3/04794* (2013.01); *F25D 23/126* (2013.01); *F25D 31/002* (2013.01)

(58) Field of Classification Search

CPC .... F25D 29/005; F25D 23/126; F25D 31/002; B01F 3/04794; B67D 1/0861

See application file for complete search history.

(56) References Cited

U.S. PATENT DOCUMENTS

| | | | | |
|---|---|---|---|---|
| 2,826,401 | A | 3/1958 | Peters | |
| 2010/0066226 | A1 | 3/2010 | Luisi et al. | |
| 2010/0251901 | A1 | 10/2010 | Santoiemmo | |
| 2012/0107463 | A1 | 5/2012 | Santoiemmo | |
| 2013/0037969 | A1* | 2/2013 | Ring | B01F 3/04794 261/63 |

(Continued)

FOREIGN PATENT DOCUMENTS

| | | |
|---|---|---|
| CN | 203474432 | 3/2014 |
| CN | 104019611 | 9/2014 |
| CN | 104039431 | 9/2014 |

(Continued)

OTHER PUBLICATIONS

Extended European Search Report dated Jul. 8, 2016 from European Patent Application No. 16155471.2, 8 pages.

(Continued)

*Primary Examiner* — James J Yang
(74) *Attorney, Agent, or Firm* — Staas & Halsey LLP

(57) ABSTRACT

A refrigerator includes a mixing container in which carbon dioxide and purified water are mixed and carbonated water is prepared, a mounting body on or from which the mixing container is mountable or detachable, a first dispenser assembly which injects the carbon dioxide and the purified water into the mixing container when the mixing container is mounted on the mounting body, and a user interface which outputs information on whether the mixing container is mounted on the mounting body.

15 Claims, 30 Drawing Sheets

(56) References Cited

U.S. PATENT DOCUMENTS

| | | | | |
|---|---|---|---|---|
| 2013/0312872 | A1* | 11/2013 | Tobbe | B67D 1/1236 141/83 |
| 2014/0070431 | A1* | 3/2014 | Hatherell | B67D 1/0057 261/30 |

FOREIGN PATENT DOCUMENTS

| | | | | |
|---|---|---|---|---|
| CN | 105371581 | | 3/2016 | |
| EP | 1503952 | | 2/2005 | |
| EP | 1580502 | | 9/2005 | |
| EP | 1580502 | A1 * | 9/2005 | B01F 3/04794 |
| EP | 1580502 | A1 * | 9/2005 | B01F 3/04794 |
| EP | 2238078 | | 10/2010 | |
| GB | 2097274 | | 11/1982 | |
| JP | 3-85292 | | 4/1991 | |
| JP | 2003-26293 | | 1/2003 | |
| KR | 10-2005-0095339 | | 9/2005 | |
| KR | 10-2008-0016770 | | 2/2008 | |
| KR | 10-2010-0011767 | | 2/2010 | |
| KR | 10-2010-0035280 | | 4/2010 | |
| KR | 10-2010-0052791 | | 5/2010 | |
| KR | 10-2010-0060218 | | 6/2010 | |
| KR | 10-2011-0003952 | | 1/2011 | |
| KR | 10-2011-0098419 | | 9/2011 | |
| KR | 10-1245635 | | 3/2013 | |
| KR | 10-2013-0044988 | | 5/2013 | |
| KR | 10-2014-0102082 | | 8/2014 | |
| WO | WO 2016/024730 | | 2/2016 | |

OTHER PUBLICATIONS

European Communication dated Aug. 7, 2017 in European Patent Application No. 16155471.2.

Chinese Office Action dated Dec. 29, 2018 in Chinese Patent Application No. 201610090153.9.

* cited by examiner

REFRIGERATOR AND METHOD OF CONTROLLING THE SAME

CROSS-REFERENCE TO RELATED APPLICATIONS

This application claims the priority benefit of Korean Patent Application No. 10-2015-0024063, filed on Feb. 17, 2015 in the Korean Intellectual Property Office, the disclosure of which is incorporated herein by reference.

BACKGROUND

1. Field

The following description relates to a refrigerator and a method of controlling the same.

2. Description of the Related Art

Refrigerators are apparatuses for storing an object at a low temperature and may include a storage compartment in which the object is stored and a cooling portion which supplies cooling air to the storage compartment to maintain the storage compartment at a predetermined temperature or less.

Refrigerators may maintain the storage compartment at a user's preferred temperature or less by repetitive evaporation and compression of a refrigerant. To perform cycles of the evaporation and compression of the refrigerant, refrigerators may include an evaporator, a compressor, a condenser, an expansion valve, etc.

Also, refrigerators may further be provided with portions for performing many additional functions for various requirements by the users. For example, refrigerators may further include an ice making portion for making ice and a dispenser which allows users to get purified water or ice without opening a door.

SUMMARY

Therefore, it is an aspect of the present disclosure to provide a refrigerator which prepares and supplies carbonated water by fastening a mixing container to a carbonated water preparing module, in which information on fastening or releasing the mixing container may be easily and intuitively provided to a user and a method of controlling the refrigerator.

It is an aspect of the present disclosure to provide a refrigerator which prepares and supplies carbonated water by fastening a mixing container to a carbonated water preparing module, in which negligent accidents which may occur when a carbonated water preparing process is performed while the mixing container is not fastened may be prevented and a method of controlling the refrigerator.

Additional aspects of the disclosure will be set forth in part in the description which follows and, in part, will be obvious from the description or may be learned by practice of the disclosure.

In accordance with an aspect of the present disclosure, a refrigerator includes a mixing container in which carbon dioxide and purified water are mixed and carbonated water is prepared, a mounting body on or from which the mixing container is mountable or detachable, a first dispenser assembly which injects the carbon dioxide and the purified water into the mixing container when the mixing container is mounted on the mounting body, and a user interface which outputs information on whether the mixing container is mounted on the mounting body.

The user interface may include a display portion which displays the information on whether the mixing container is mounted on the mounting body as an image, a lighting portion which emits light depending on whether the mixing container is mounted on the mounting body, a sound output portion which outputs a sound depending on whether the mixing container is mounted on the mounting body, and a touch screen portion which displays the information on whether the mixing container is mounted on the mounting body and receives a touch operation input.

The user interface may output mounting information which indicates that the mixing container is mounted when the mixing container is mounted on the mounting body.

The user interface may output detachment information which indicates that the mixing container is detached when the mixing container is detached from the mounting body.

The user interface may include an operation portion operated by a user.

The user interface may further include a lighting portion for the operation portion which is disposed on the operation portion or the periphery of the operation portion and emits light depending on whether the mixing container is mounted on the mounting body.

The refrigerator may further include a second dispenser assembly which ejects purified water or ice when the mixing container is detached from the mounting body.

In accordance with an aspect of the present disclosure, a refrigerator includes a mixing container in which carbon dioxide and purified water are mixed and carbonated water is prepared, a mounting body on or from which the mixing container is mountable or detachable, a first dispenser assembly which injects the carbon dioxide and the purified water into the mixing container when the mixing container is mounted on the mounting body, and an operation portion through which a command for controlling the first dispenser assembly is allowed to be input when the mixing container is mounted on the mounting body.

When the mixing container is detached from the mounting body, the input of the command for controlling the first dispenser assembly may be prevented from being input through the operation portion.

The operation portion may include at least one of a first operation portion which receives a command to start preparing of carbonated water, a second operation portion which receives a command to add carbon dioxide, and a third operation portion which receives a command to adjust the concentration of the carbon dioxide.

In accordance with an aspect of the present disclosure, a method of controlling a refrigerator which includes a mixing container in which carbon dioxide and purified water are mixed and carbonated water is prepared, a mounting body on or from which the mixing container is mountable or detachable, a first dispenser assembly which injects the carbon dioxide and the purified water into the mixing container, and a user interface capable of outputting information includes determining whether the mixing container is coupled with the mounting body and outputting by the user interface information on whether the mixing container is mounted the mounting body when the mixing container is coupled with the mounting body.

The outputting by the user interface of the information on whether the mixing container is mounted on the mounting body when the mixing container is coupled with the mounting body may include at least one of displaying the information on whether the mixing container is mounted on the mounting body as an image, emitting light by the lighting portion depending on whether the mixing container is mounted on the mounting body, outputting a sound depending on whether the mixing container is mounted on the mounting body, and displaying the information on whether the mixing container is mounted on the mounting body and receiving a touch operation input by a touch screen portion.

The outputting by the user interface of the information on whether the mixing container is mounted on the mounting body when the mixing container is coupled with the mounting body may include outputting mounting information which indicates that the mixing container is mounted on the mounting body when the mixing container is mounted on the mounting body.

The outputting by the user interface of the information on whether the mixing container is mounted on the mounting body when the mixing container is coupled with the mounting body may include outputting detachment information which indicates that the mixing container is detached from the mounting body when the mixing container is detached from the mounting body.

The user interface may further include an operation portion operated by a user and a lighting portion for the operation portion disposed the operation portion or the periphery of the operation portion.

The method may further include emitting light, performed by the lighting portion for the operation portion, depending on whether the mixing container is mounted on the mounting body.

The method may further include preparing carbonated water by injecting the carbon dioxide and the purified water into the mixing container when the mixing container is coupled with the mounting body.

In accordance with an aspect of the present disclosure, a method of controlling a refrigerator which includes a mixing container in which carbon dioxide and purified water are mixed and carbonated water is prepared, a mounting body on or from which the mixing container is mountable or detachable, a first dispenser assembly which injects the carbon dioxide and the purified water into the mixing container, and an operation portion for controlling the first dispenser assembly includes determining whether the mixing container is mounted on the mounting body and activating an input capability of a command for controlling the first dispenser assembly using the operation portion when the mixing container is mounted on the mounting body.

The method may further include deactivating the input capability of the command for controlling the first dispenser assembly when the mixing container is detached from the mounting body.

The operation portion may include at least one of a first operation portion which receives a to start preparing of carbonated water, a second operation portion which receives a command to add carbon dioxide, and a third operation portion which receives a command to adjust the concentration of the carbon dioxide.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
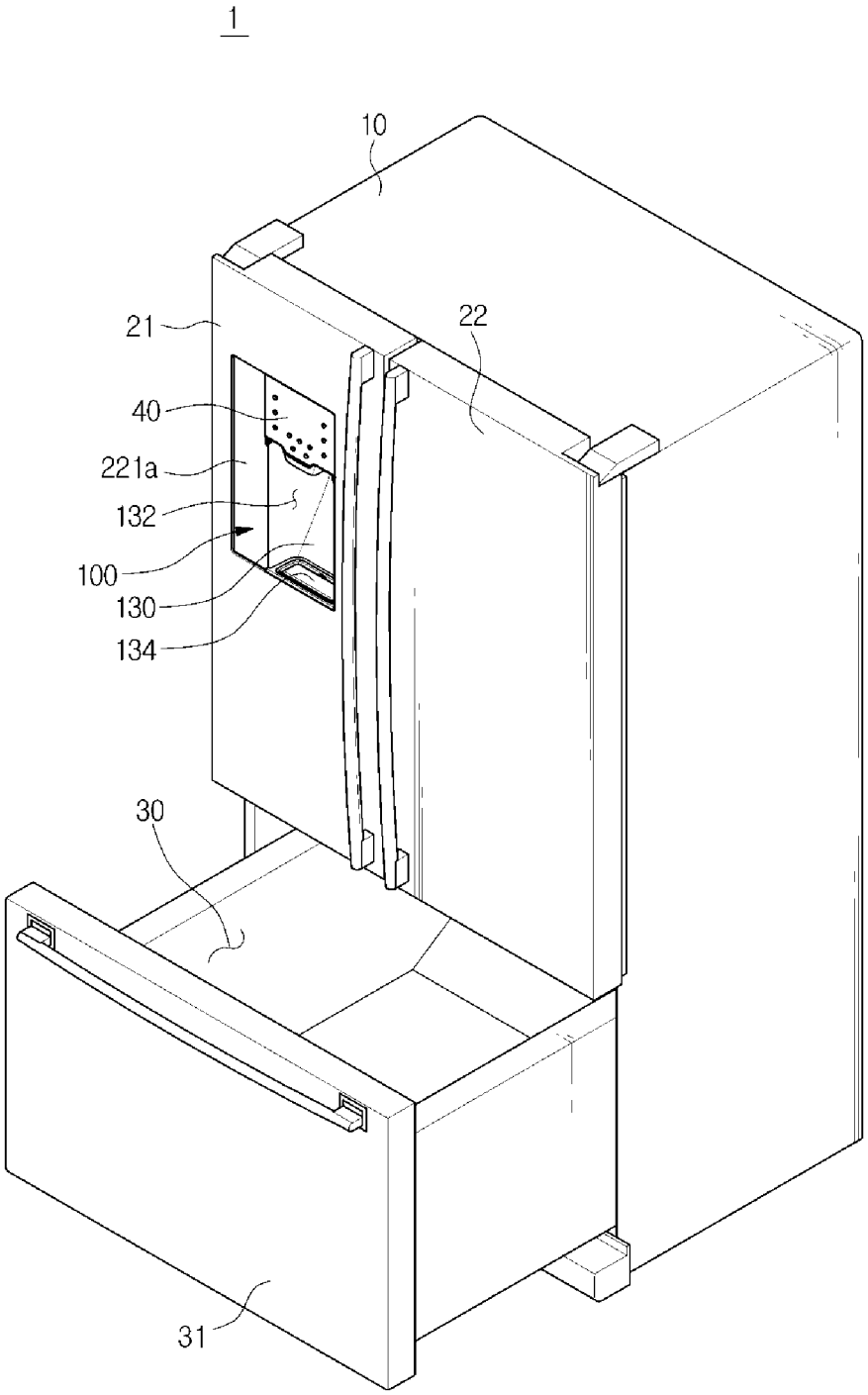
FIG. 1 is a perspective view illustrating an exterior of a refrigerator in accordance with an embodiment of the present disclosure.

Reference will now be made in detail to the embodiments, examples of which are illustrated in the accompanying drawings, wherein like reference numerals refer to the like elements throughout. The embodiments are described below to explain the present disclosure by referring to the figures.

Hereinafter, a refrigerator in accordance with an embodiment of the present disclosure will be described.

Figure 2:
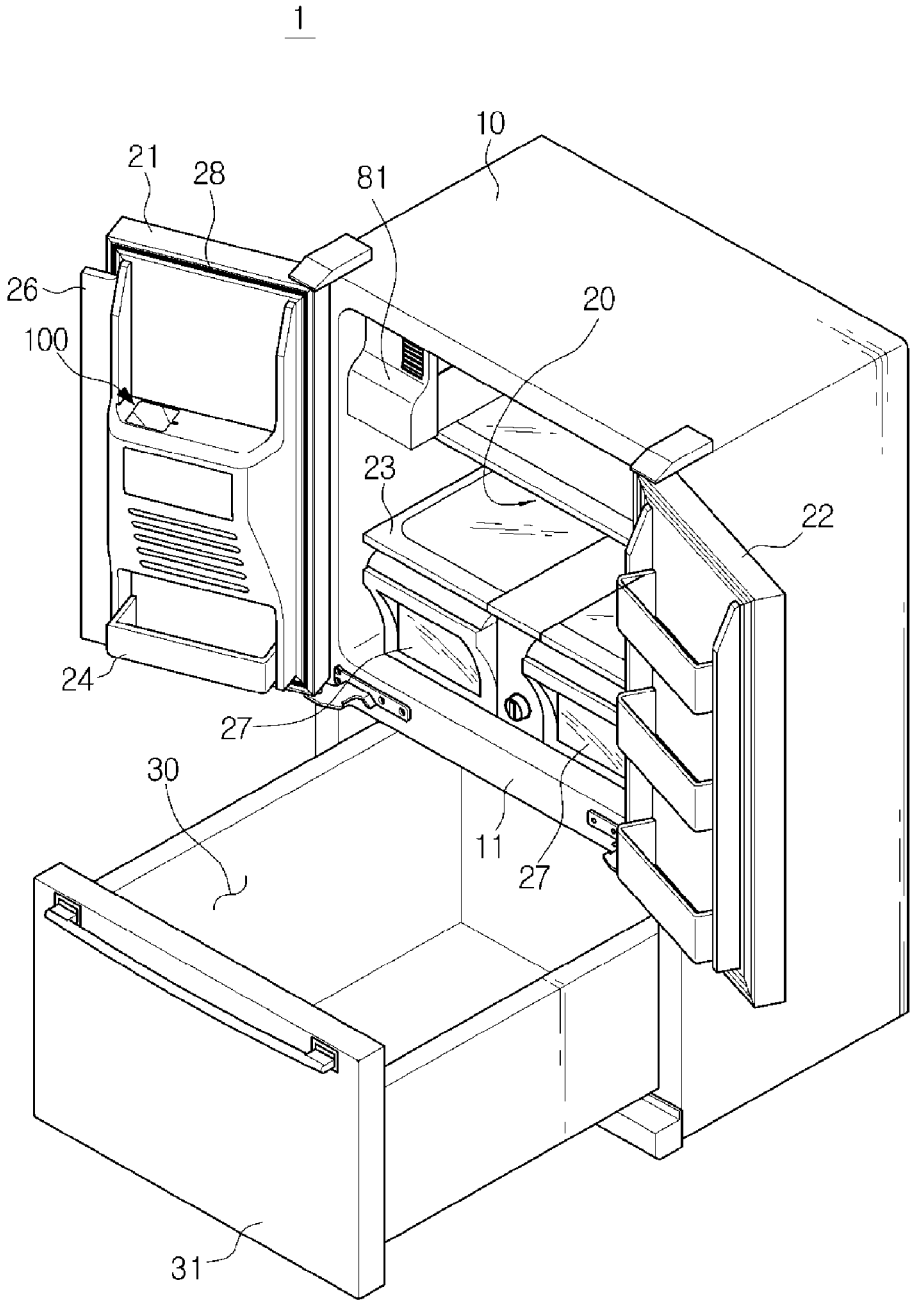
FIG. 2 is a perspective view illustrating an exterior of the refrigerator with open doors.

FIG. 1 is a perspective view illustrating an exterior of a refrigerator in accordance with an embodiment of the present disclosure. FIG. 2 is a perspective view illustrating an exterior of the refrigerator with open doors.

Referring to FIGS. 1 and 2, a refrigerator 1 may include a body 10 which forms an exterior of the refrigerator 1 and one or more storage compartments 20 and 30 formed in an inner space of the body 10. Doors 21, 22, and 31 configured to open and close the storage compartments 20 and 30 may be provided on one side of the body 10.

The body 10 may include an inner casing which forms the storage compartments 20 and 30, an outer casing assembled with the outside of the inner casing to form the exterior of the refrigerator 1, and an insulator disposed between the inner casing and the outer casing to insulate the storage compartments 20 and 30 from the outside.

The storage compartments 20 and 30 may be divided by an intermediate partition wall 11 into a plurality of storage compartments 20 and 30. In this case, the intermediate partition wall 11 may vertically divide the storage compartments 20 and 30 or horizontally divide the storage compartments 20 and 30. Depending on embodiments, the refrigerator 1 may include a plurality of intermediate partition walls 11, thereby providing storage compartments 20 and 30 divided into three or more storage compartments in the refrigerator 1.

The plurality of storage compartments 20 and 30 may include a refrigeration compartment for storing an object at a cool temperature and a freezing compartment for storing an object at a frozen temperature. The storage compartment may be maintained at a temperature of approximately three degrees Celsius above zero to store the object under refrigeration. The freezing compartment may be maintained at a temperature of approximately 18.5 degrees below zero Celsius to store the object frozen.

Here, an object indicates various articles stored under refrigeration at a low temperature and may include, for example, food or medications.

The compartment 20 may include a shelf 23 for allowing the object to be put thereon and at least one storage box 27 for storing the object. The at least one storage box 27 may be installed in the storage compartment 20 to be drawn out by a user from the inside of the storage compartment 20. In addition, various devices for convenience of users may be installed inside the storage compartment 20.

The storage compartments 20 and 30 may have open fronts for taking food in or out. The open fronts may be opened and closed by a pair of doors coupled with the body 10 using hinges. Depending on embodiments, the open front may be opened and closed by a sliding door 31 movable by sliding on the body 10.

The storage compartment doors 21 and 22 may include front sides externally exposed and rear sides which face the storage compartments 20 and 30 when the storage compartment doors 21 and 22 are closed.

At the front side of at least one storage compartment doors 21 and 31, a part of a dispenser assembly 100 may be exposed, and a user interface 40 which receives a control command related to an operation of the refrigerator 1 from the user and displays the operation information of the refrigerator 1 may be installed.

The dispenser assembly 100 provides purified water, carbonated water, or ice through the exposed part at the front, thereby allowing the user to get the purified water, carbonated water, or ice outside without opening the storage compartment door 21.

The user interface 40 may be provided on the dispenser assembly 100. In accordance with an embodiment, the user interface 40 may include a display portion 41 (refer to FIG. 20) which displays the operation information of the refrigerator 1 to the user, a lighting portion 42 (refer to FIG. 20), and an operation portion 45 (refer to FIG. 20) which receives various control commands related to the refrigerator 1 from the user.

The display portion 41 may display various pieces of information such as an operation state of the refrigerator 1, current temperature of each the storage compartments 20 and 30, whether to prepare carbonated water, concentration of carbon dioxide in the carbonated water to be prepared, and information necessary for the convenience of users.

The lighting portion 42 may display the operation or state of the refrigerator 1 for the user using flickering light patterns or color of light.

The operation portion 45 may be embodied by a physical button, touch button, etc. and may receive various commands necessary for controlling the refrigerator 1 including a target temperature of the storage compartment 20, a target temperature of the freezing compartment 30, a carbonated water preparing command, a carbonated water target concentration, etc. from the user.

The dispenser assembly 100 and the user interface 40 will be described below.

Door guards 24 capable of containing food may be provided on rear sides of the storage compartment doors 21 and 22. Gaskets 28 which seal gaps between the storage compartment doors 21 and 22 and the body 10 to keep cool air inside the storage compartment 20 when the storage compartment doors 21 and 22 close the storage compartments 20 and 30 may be provided on edges of the rear sides of the storage compartment doors 21 and 22.

The storage compartment door 21 that is at least one of the storage compartment doors 21 and 22 may include a pivoting bar 26 which seals a gap between the storage compartment door 21 and the storage compartment door 22 to keep the cool air inside the storage compartment 20 when the storage compartment doors 21 and 22 are closed.

A first dispenser assembly 200 which prepares and provides carbonated water to the user may be mounted on the door 21 of the refrigerator 1. Detailed components and an operation of the first dispenser assembly 200 will be described below.

Figure 3:
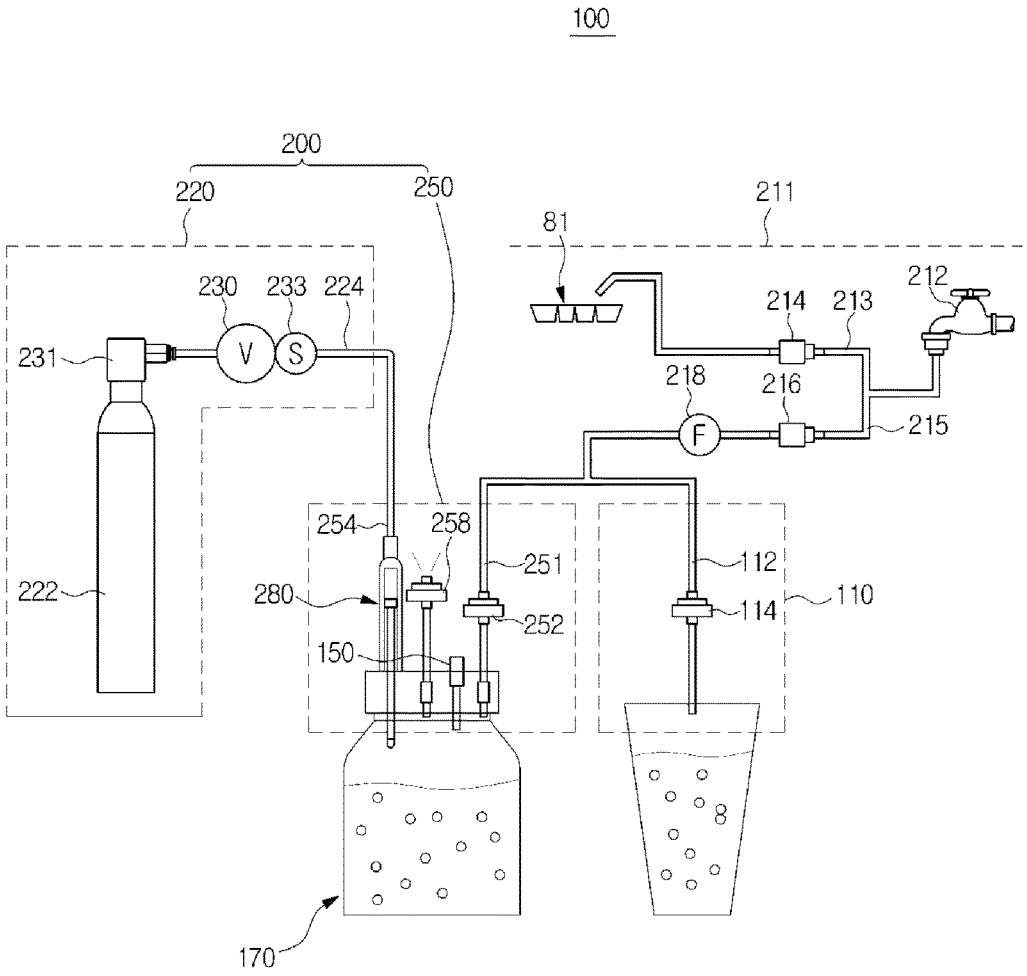
FIG. 3 is a view illustrating a process of preparing and supplying carbonated water and a process of preparing or supplying ice or purified water in the refrigerator.

FIG. 3 is a view of a dispenser assembly which performs preparing and supplying of carbonated water or preparing or supplying ice or purified water in a refrigerator.

The dispenser assembly 100 may include a purified water supply portion 211 which provides purified water to the first dispenser assembly 200 or the second dispenser assembly 110, the first dispenser assembly 200 which prepares and provides carbonated water to the user, and the second dispenser assembly 110 which dispenses and provides purified water or ice to the user.

The purified water supply portion 211 may include a water source 212, a purified water flow channel 215 through which water to be supplied to the second dispenser assembly 110 or a carbonated water preparing module 250 flows, and a purified water valve 216 which cuts off or opens the purified water flow channel 215. Also, depending on embodiments, the purified water supply portion 211 may further include an ice making flow channel 213 which connects the water source 212 with an ice making device 81 and an ice making valve 214 which cuts off or opens the ice making flow channel 213. Also, the purified water supply portion 211 may further include a flow sensor 218 which detects an amount of purified water supplied to the second dispenser assembly 110 or the carbonated water preparing module 250.

The water source 212 is a device which supplies water to the purified water supply portion 211 and may be an additional water tank or a water pipe connected to homes or factories. The water source 212 may be connected to at least one of the ice making flow channel 213 and the purified water flow channel 215. The water supplied from the water source 212 may be transferred to the second dispenser assembly 110, the carbonated water preparing module 250, or the ice making device 81 through the ice making flow channel 213 or the purified water flow channel 215.

The ice making valve 214 is provided to open and close the ice making flow channel 213 through which purified water from the water source 212 is supplied to the ice making device 81. The purified water valve 216 is provided to open and close the purified water flow channel 215 through which purified water from the water source 212 is supplied to the second dispenser assembly 110 or the carbonated water preparing module 250.

The ice making valve 214 and the purified water valve 216 may regulate a strong water pressure from the water source 212 and may adjust an amount of purified water transferred to the ice making device 81, the second dispenser assembly 110, or the carbonated water preparing module 250. The ice making valve 214 and the purified water valve 216, for example, may employ a solenoid valve. However, types or shapes of the ice making valve 214 and the purified water valve 216 are not limited thereto.

The ice making valve 214 and the purified water valve 216 may be provided to be directly connected to the water source 212 through the flow channels 213 and 215 to supply purified water. Depending on embodiments, a flow channel switch valve (not shown) may be provided between the water source 212, and the ice making valve 214 and the purified water valve 216.

The flow channel switch valve may be a valve designed to supply water supplied from the water source 212 to at least one of the second dispenser assembly 110, the carbonated water preparing module 250, and the ice making device 81.

For example, when an ice making operation is unnecessary, the flow channel switch valve opens the purified water flow channel 215 connected to the second dispenser assembly 110 or the carbonated water preparing module 250 and closes the ice making flow channel 213 connected to the ice making device 81, thereby supplying purified water only to the second dispenser assembly 110 or the carbonated water preparing module 250. Also, when the ice making operation is necessary, the flow channel switch valve closes the flow channel 215 connected to the second dispenser assembly 110 or the carbonated water preparing module 250 and opens the flow channel 213 connected to the ice making device 81, thereby allowing the ice making operation to be performed.

In accordance with an embodiment, the flow channel switch valve may be embodied using a three-way valve connected to an inlet connected to the water source 212, a first outlet connected to the ice making device 81, and a second outlet connected to the second dispenser assembly 110 or the carbonated water preparing module 250.

The flow sensor 218 may calculate an amount of purified water supplied from the water source 212 to the second dispenser assembly 110 or the carbonated water preparing module 250. The flow sensor 218 is disposed between the second dispenser assembly 110 or the carbonated water preparing module 250 and the purified water valve 216 as an example as shown in FIG. 3 but is not limited thereto. For example, the flow sensor 218 may be disposed upstream of the purified water valve 216 and the ice making valve 214 and may calculate an amount of purified water supplied to the purified water supply portion 211.

The flow sensor 218 or the purified water supply portion 211 shown in FIG. 3 is merely an example of a purified water supply device employable by the refrigerator 1 but is not limited thereto.

In accordance with an embodiment, the second dispenser assembly 110 may include a dispenser supply flow channel 112 connected to the purified water supply portion 211 and a dispenser supply valve 114 which opens and closes the dispenser supply flow channel 112. The dispenser supply flow channel 112 guides purified water in a direction toward a mixing space 132. The dispenser supply valve 114 may adjust an amount of purified water supplied to the mixing space 132.

In accordance with an embodiment, the first dispenser assembly 200, as shown in FIG. 3, may include a carbon dioxide supply module 220 and the carbonated water preparing module 250.

The carbon dioxide supply module 220 includes a carbon dioxide cylinder 222 which stores carbon dioxide and a carbon dioxide supply valve 230 which adjusts an amount of carbon dioxide supplied from the carbon dioxide cylinder 222 to the carbonated water preparing module 250.

The carbon dioxide cylinder 222 may store high-pressure carbon dioxide. The gas pressure of the carbon dioxide may be from approximately 45 to approximately 60 bar.

The carbon dioxide stored in the carbon dioxide cylinder 222 may be discharged into a mixing container 170 through a carbon dioxide supply flow channel 224 which connects the carbon dioxide cylinder 222 with the carbonated water preparing module 250.

The carbon dioxide supply flow channel 224 may guide the carbon dioxide stored in the carbon dioxide cylinder 222 to the carbonated water preparing module 250.

A carbon dioxide supply valve 230 which opens and close the carbon dioxide supply flow channel 224 may be provided on the carbon dioxide supply flow channel 224. When the carbon dioxide supply valve 230 is opened, the carbon dioxide stored in the carbon dioxide cylinder 222 is discharged to the mixing container 170 through the carbon dioxide supply flow channel 224. In accordance with an embodiment, the carbon dioxide supply valve 230 may include a solenoid valve which opens and closes the carbon dioxide supply flow channel 224 according to an electrical signal. The carbon dioxide supply valve 230 will be described below in detail.

The carbon dioxide supply module 220 may include a carbon dioxide pressure sensor 233. The carbon dioxide pressure sensor 233 may sense a discharge pressure of the carbon dioxide being discharged from the carbon dioxide cylinder 222. The carbon dioxide pressure sensor 233 may be embodied using a pressure switch that, when a pressure of the discharged carbon dioxide decreases to a threshold or less, outputs a low pressure detection signal corresponding to the condition thereof.

The carbon dioxide supplied from the carbon dioxide supply module 220 and the purified water supplied from the purified water supply portion 211 flow into the mixing container 170, and carbonated water is prepared in the mixing container 170.

The carbonated water preparing module 250 is prepared to allow the mixing container 170 to be detachable and discharges carbon dioxide to the mixing container 170 to allow carbonated water to be prepared in the mixing container 170 when the mixing container 170 is coupled.

In accordance with an embodiment, the carbonated water preparing module 250 may include a purified water inlet flow channel 251 connected to the purified water supply portion 211 and a purified water inlet valve 252 which opens and closes the purified water inlet flow channel 251. An amount of purified water which flows into the mixing container 170 is adjusted by opening and closing the purified water inlet valve 252.

Also, the carbonated water preparing module 250 may include a carbon dioxide inlet flow channel 254 connected to the carbon dioxide supply module 220 and a nozzle module 280 provided to operate due to carbon dioxide which flows into the carbon dioxide inlet flow channel 254. The nozzle module 280 is provided to operate due to carbon dioxide supplied to the carbonated water preparing module 250 and to inject the supplied carbon dioxide into the mixing container 170.

The nozzle module 280 will be described below in detail.

The carbonated water preparing module 250 may include a vent valve 258. The vent valve 258 is provided to prevent a pressure in the mixing container 170 from excessively increasing due to injected carbon dioxide when carbon dioxide is injected into the mixing container 170. In detail, when a pressure of carbon dioxide in the mixing container 170 exceeds a predetermined level, the vent valve 258 is opened, and the carbon dioxide in the mixing container 170 is discharged to the outside.

The first dispenser assembly 200 may include a relief valve 150. The relief valve 150 is provided to discharge purified water or carbonated water that overflows when purified water exceeding a predetermined amount is supplied or carbonated water exceeding a predetermined amount is prepared during a process of preparing carbonated water.

Figure 4:
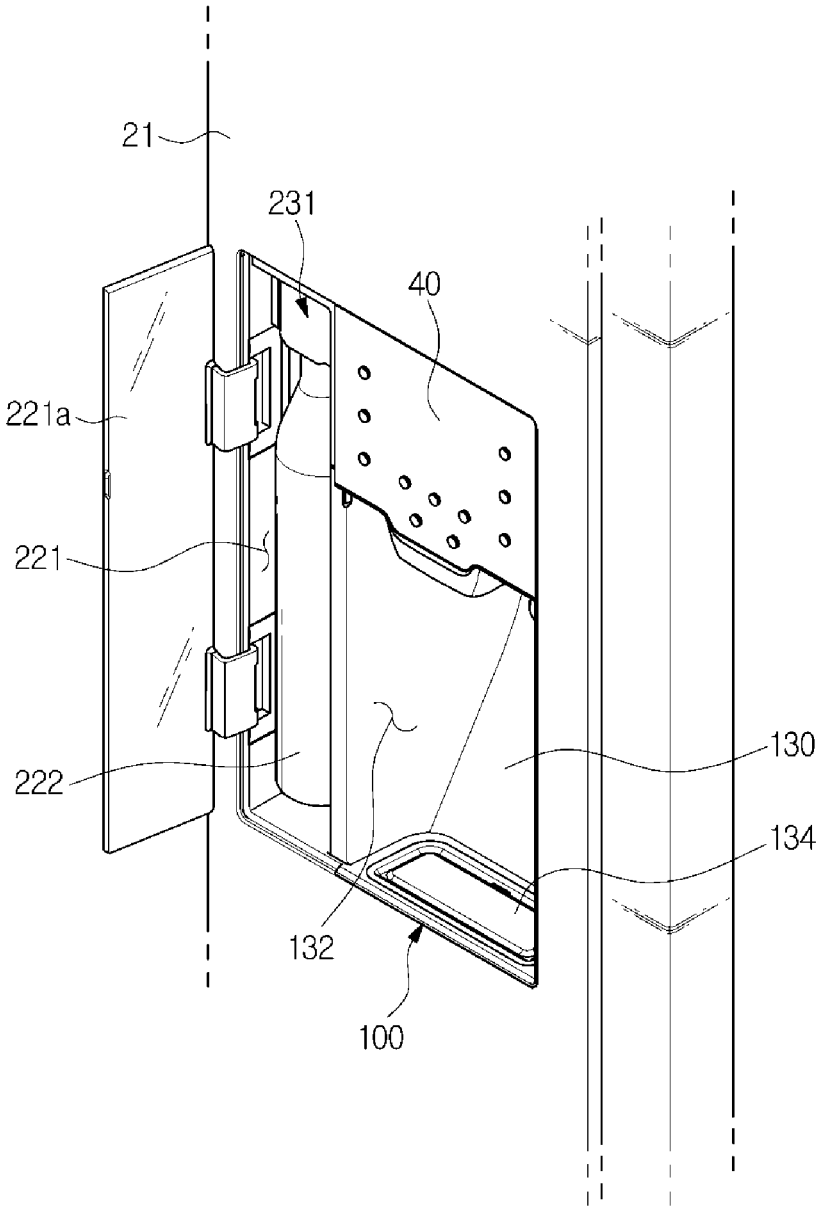
FIG. 4 is a view illustrating an example of a dispenser.

FIG. 4 is a view illustrating an example of a dispenser.

The dispenser assembly 100 may be installed in the door 21. The dispenser assembly 100 may include the mixing space 132 exposed at a front of the door 21 and a dispenser housing 130 formed as a recess from the front of the door 21 toward the rear of the door 21 to form the mixing space 132.

The mixing space 132 may accommodate the mixing container 170. The mixing container 170 may be provided to be detachable from the carbonated water preparing module 250 in the mixing space 132. Also, a mounting body 272 (refer to FIG. 5) of the carbonated water preparing module 250 on which the mixing container 170 is mounted may be provided to be exposed toward the mixing space 132.

In the mixing space 132, a dispenser lever 136 (refer to FIG. 5) operable by the user to control discharging of purified water or ice made by the ice making device 81 may be provided. According to an operation of the dispenser lever 136, the second dispenser assembly 110 may discharge purified water or ice into the mixing space 132.

A water collecting case 134 which collects discharged liquid left in the mixing space 132 such as purified water and carbonated water may be provided at a bottom of the dispenser housing 130. To easily collect the discharged liquids discharged into the mixing space 132 in the water collecting case 134, an inner surface of the dispenser housing 130 may be tilted at a predetermined angle.

The dispenser housing 130 may include a cylinder accommodation space 221 into or from which the carbon dioxide cylinder 222 can be inserted or removed. The cylinder accommodation space 221 may be provided adjacent to the mixing space 132 and, for example, may be formed on one side of the mixing space 132 as shown in FIG. 4. The carbon dioxide cylinder 222 is disposed in the cylinder accommodation space 221, and the carbon dioxide cylinder 222 may be mounted on a cylinder connector 231 provided inside the cylinder accommodation space 221. When the carbon dioxide cylinder 222 is mounted on the cylinder connector 231, carbon dioxide of the carbon dioxide cylinder 222 may be supplied to the carbon dioxide supply flow channel 224. The dispenser housing 130 may include a cylinder door 221*a* to open and close the cylinder accommodation space 221. For example, the cylinder door 221*a* may open and close the cylinder accommodation space 221 by a hinge coupling.

In accordance with an embodiment, the user interface 40 described above may be installed on a part of the dispenser housing 130. As described above, the user interface 40 may include the display portion 41 which displays the operation information of the refrigerator 1 to the user, the lighting portion 42, and the operation portion 45 which receives various control commands related to the refrigerator 1 from the user.

The first dispenser assembly 200 may be provided inside the dispenser housing 130 and may supply purified water and carbon dioxide to the mixing container 170 accommodated in the mixing space 132.

Figure 5:
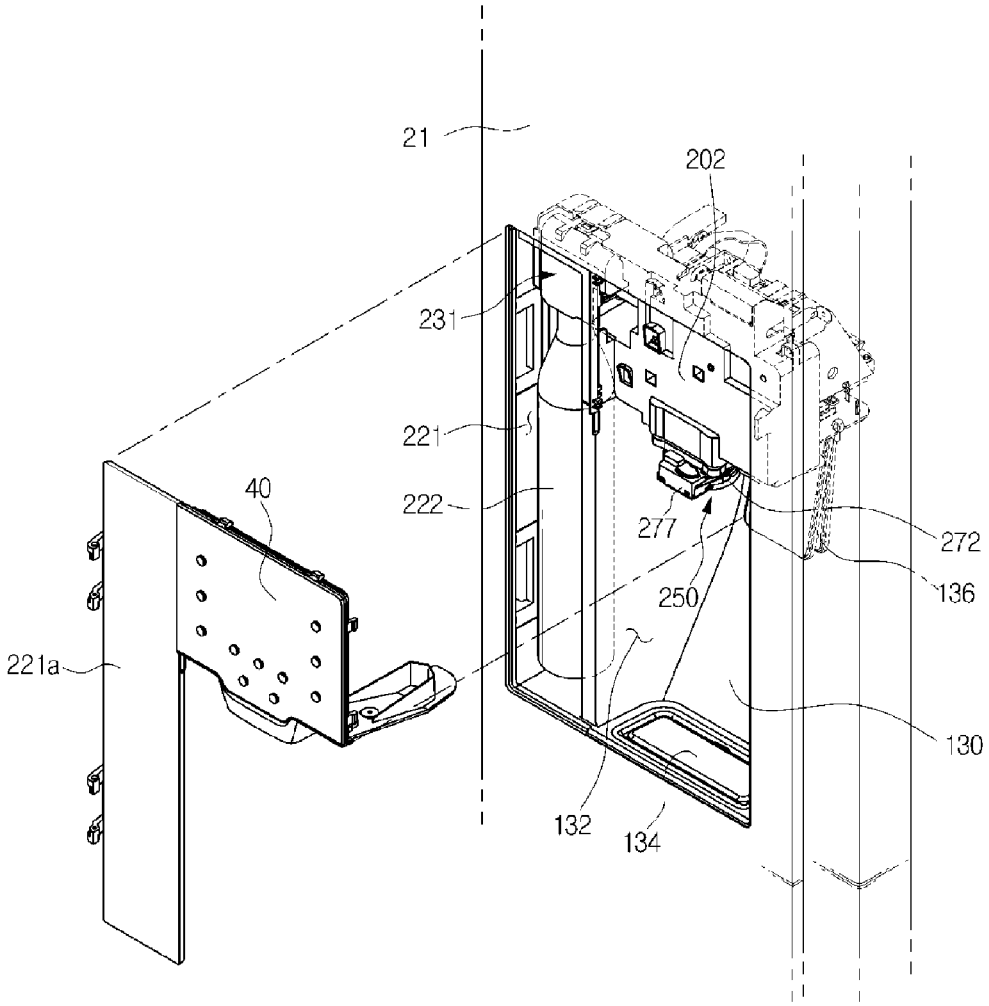
FIG. 5 is a view illustrating a carbon dioxide supplying module and a carbonated water preparing module installed in the dispenser.
Figure 6:
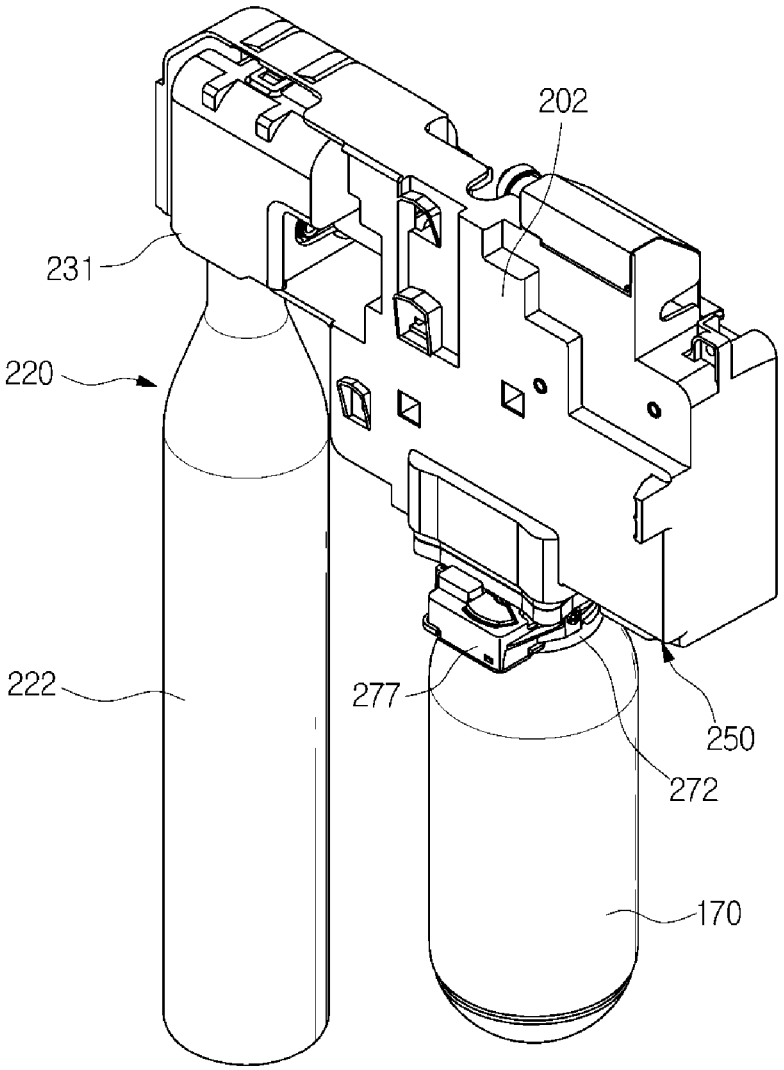
FIG. 6 is a view illustrating the carbon dioxide supplying module and the carbonated water preparing module.
Figure 7:
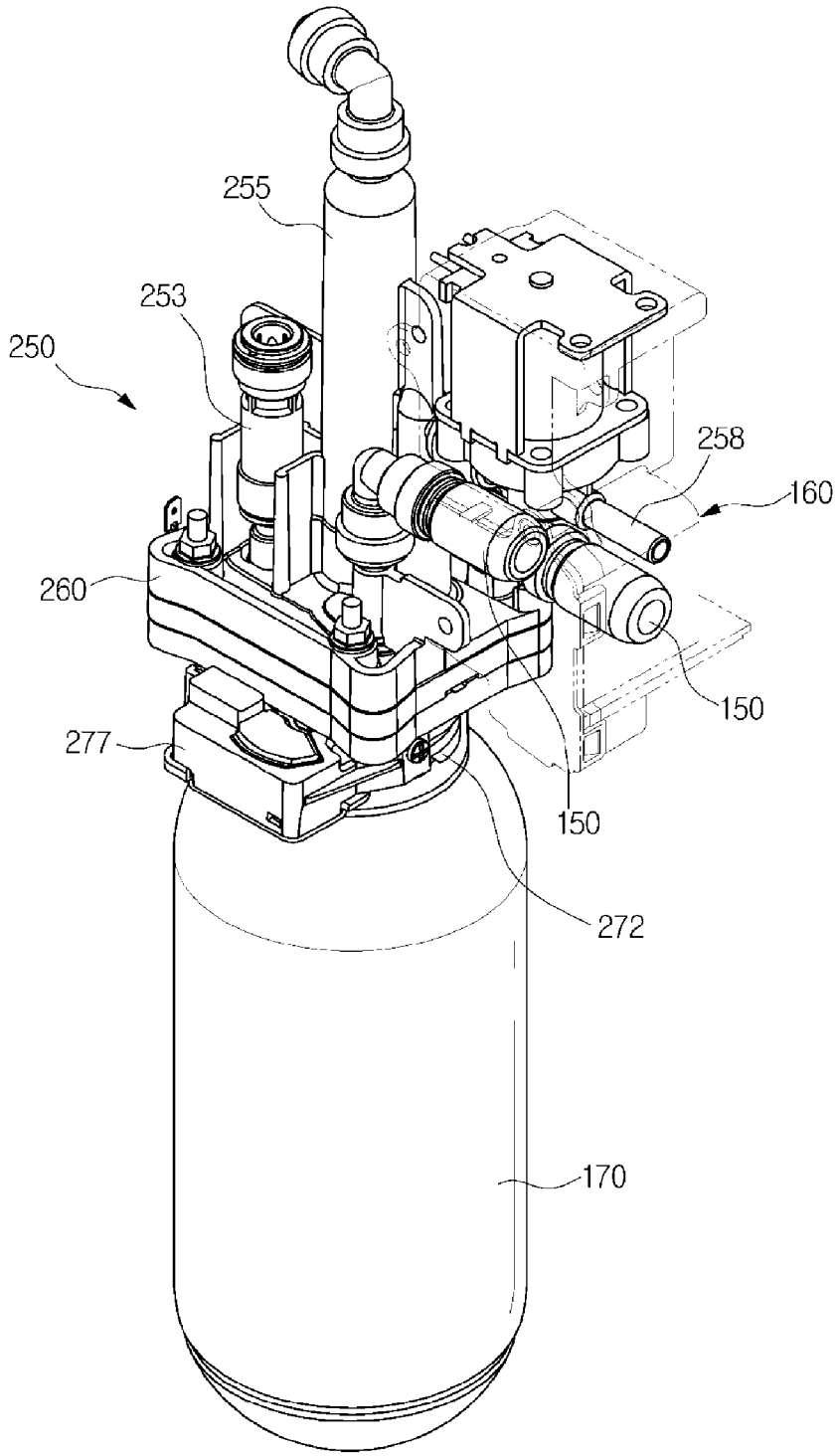
FIG. 7 is a view illustrating the carbonated water preparing module and a mixing container.
Figure 8:
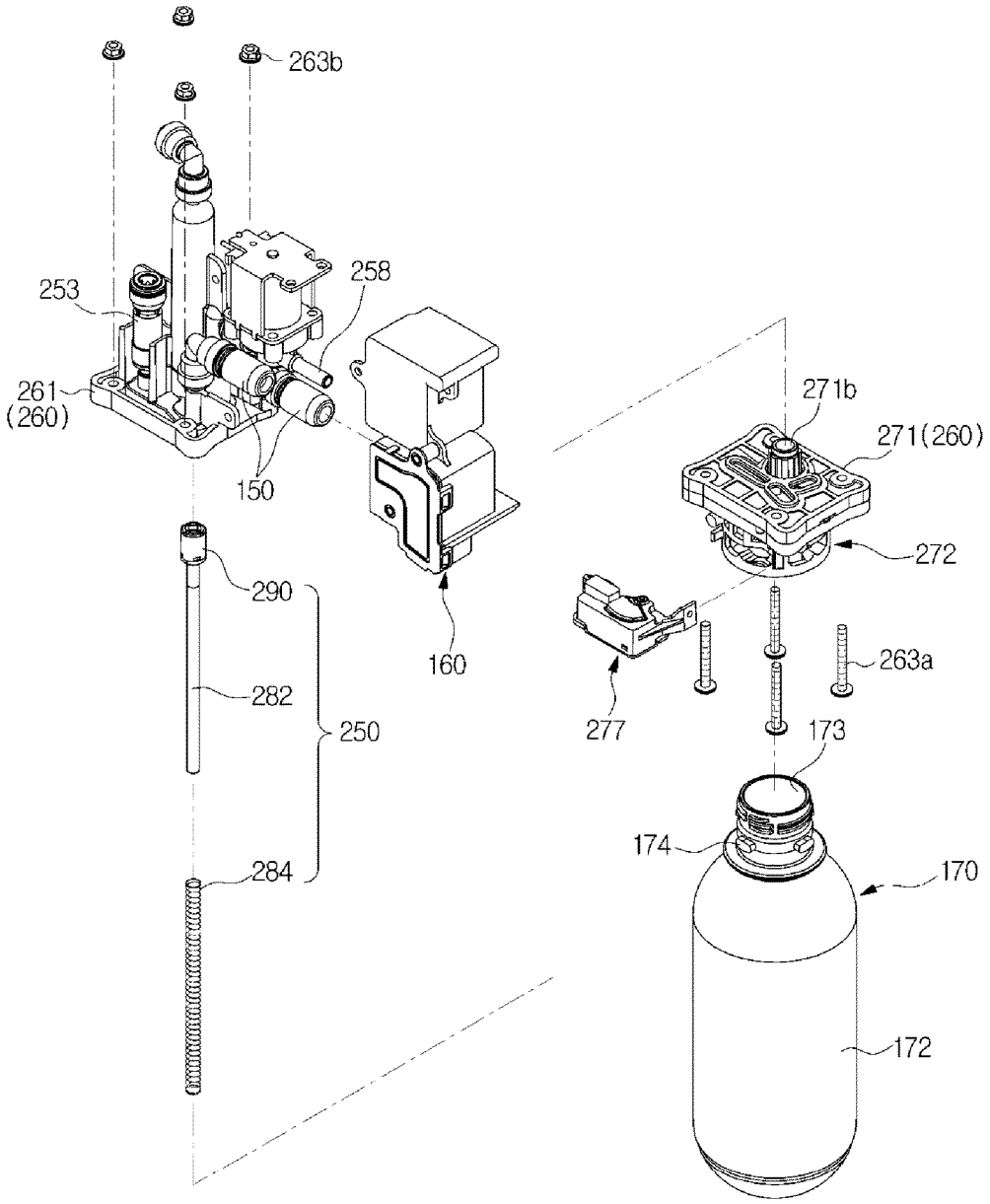
FIG. 8 is an exploded perspective view illustrating the carbonated water preparing module and the mixing container.
Figure 9:
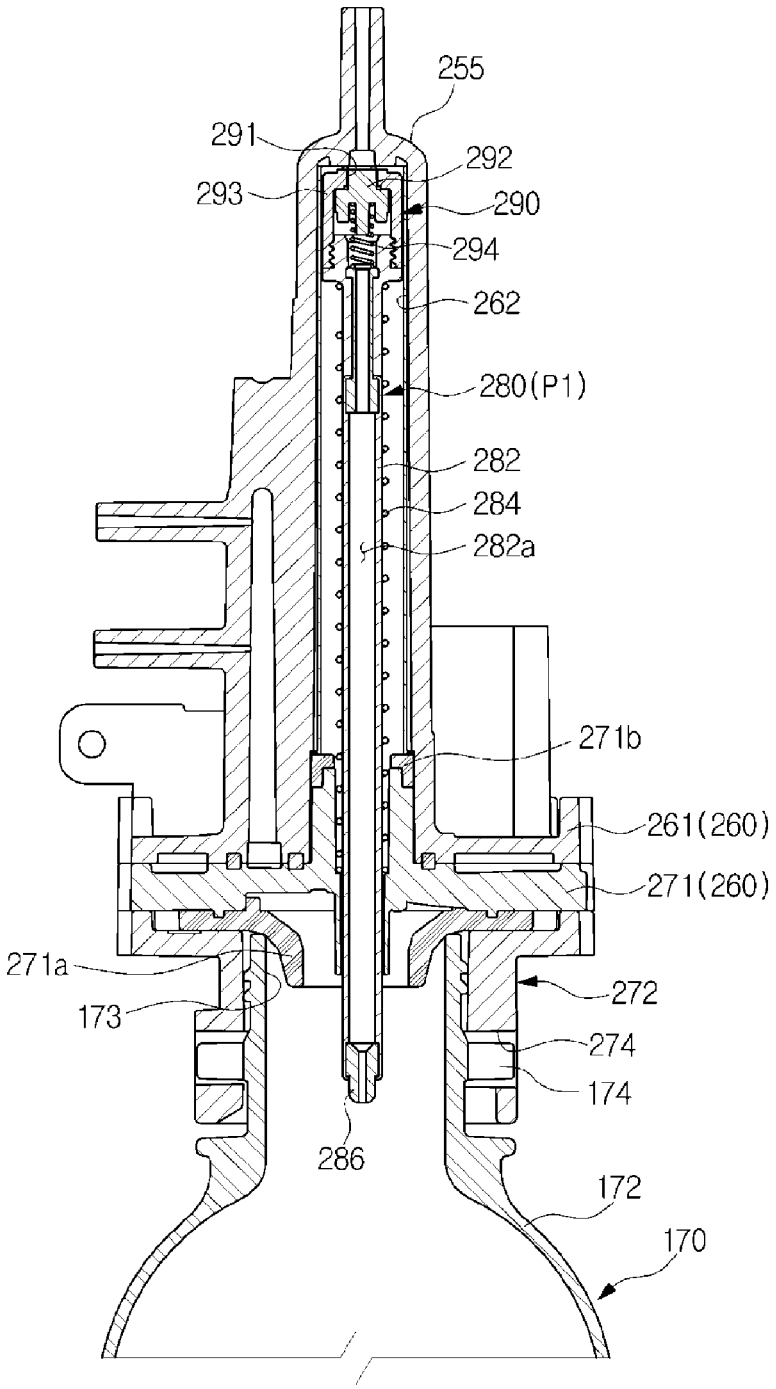
FIGS. 9, 10, 11, and 12 are views of a nozzle module.
Figure 10:
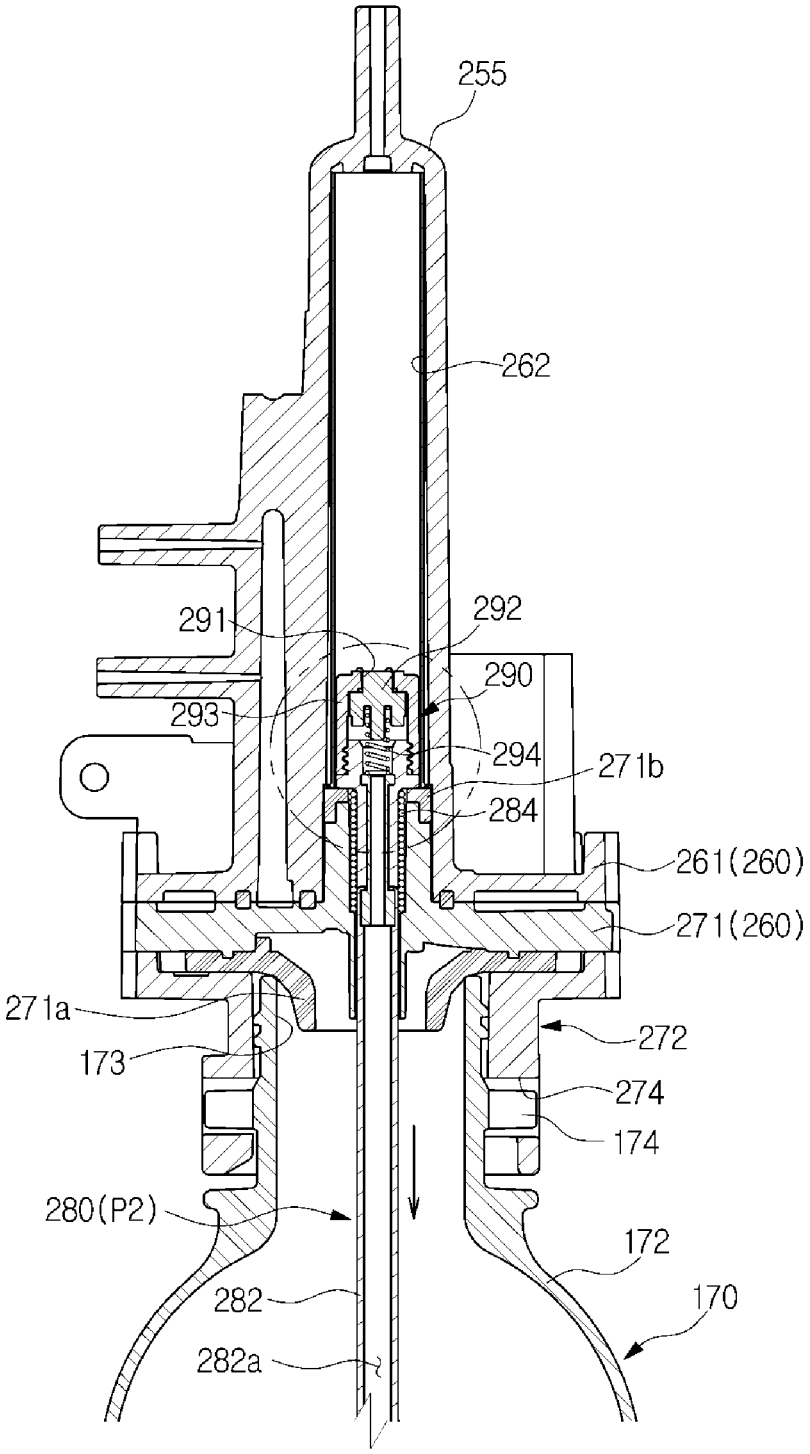
Figure 11:
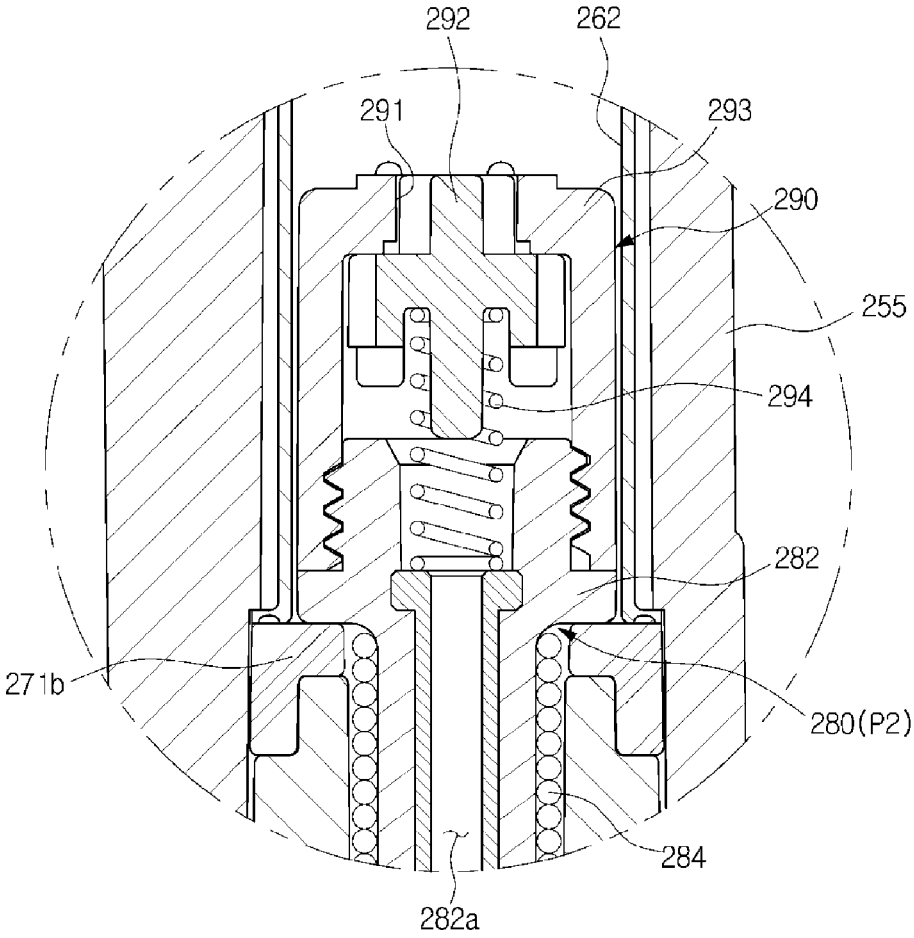
Figure 12:
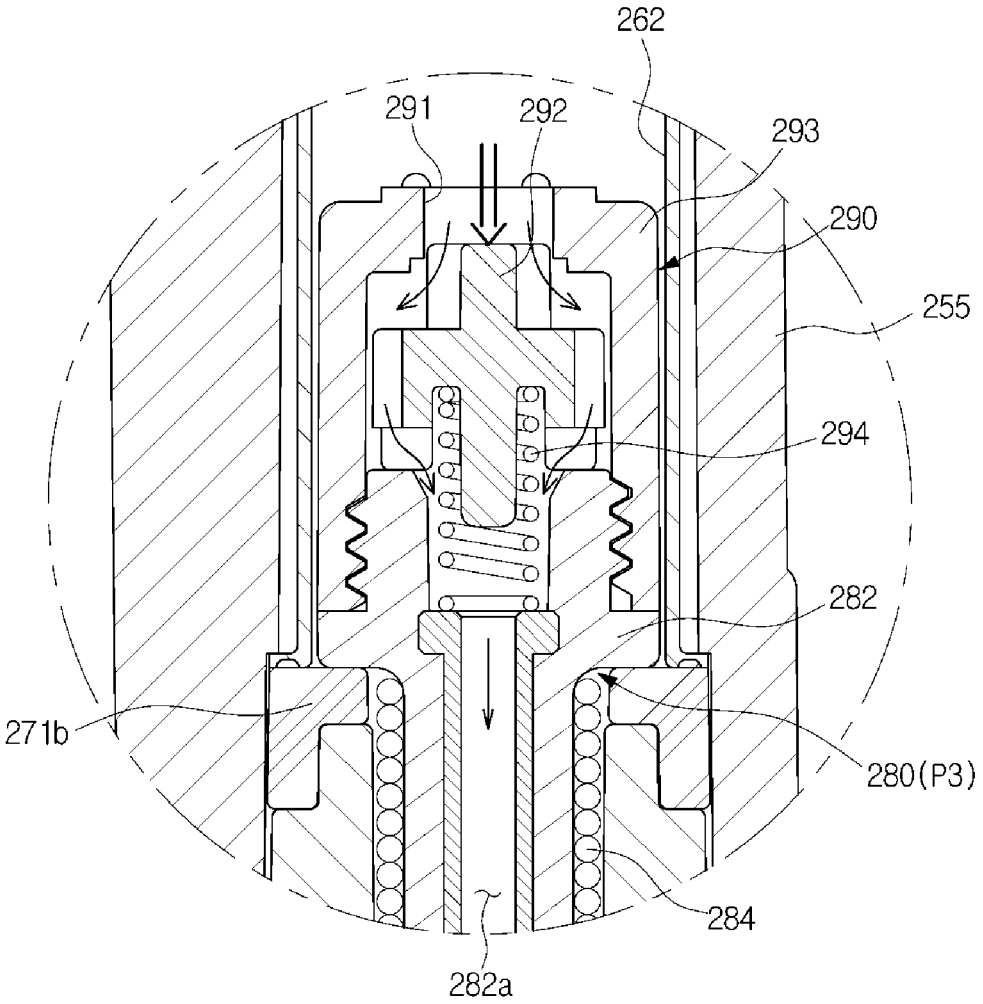

FIG. 5 is a view illustrating a carbon dioxide supplying module and a carbonated water preparing module installed in a dispenser. FIG. 6 is a view illustrating the carbon dioxide supplying module and the carbonated water preparing module. FIG. 7 is a view illustrating the carbonated water preparing module and a mixing container. FIG. 8 is an exploded perspective view illustrating the carbonated water preparing module and the mixing container.

As shown in FIG. 5, the first dispenser assembly 200 may include a module cover 202 for surrounding the outside of the carbon dioxide supply module 220 or the carbonated water preparing module 250. The module cover 202 allows the flow channels through which purified water and carbon dioxide flow and connection portions of the respective flow channels in the first dispenser assembly 200 not to be exposed to the outside, thereby preventing damages caused by an external shock. Also, the module cover 202 may be provided to cover at least parts of the carbon dioxide supply module 220 and the carbonated water preparing module 250. Accordingly, the module cover 202 may block noise generated while purified water and carbon dioxide flow.

The carbonated water preparing module 250 may be provided to allow the mixing container 170 to be mountable and detachable and may inject purified water and carbon dioxide into the mounted mixing container 170.

The carbonated water preparing module 250 may include a preparing module body 260.

The preparing module body 260 may include the mounting body 272 on which the mixing container 170 is mounted. The mounting body 272 is provided to be exposed to the mixing space 132 to allow the mixing container 170 to be mountable thereon. That is, the mixing container 170 is provided to be mounted on the mounting body 272 and is configured to be detachable from the mounting body 272. A mounting sensor 277 which senses mounting of the mixing container 170 is provided on one side of the mounting body 272. The mounting body 272 and the mounting sensor 277 will be described below in detail.

The carbonated water preparing module 250 may include a purified water inlet pipe 253 which forms the purified water inlet flow channel 251 and a carbon dioxide inlet pipe 255 which forms the carbon dioxide inlet flow channel 254. Purified water which flows through the purified water flow channel 215 may flow into the purified water inlet pipe 253. Carbon dioxide which flows through the carbon dioxide inlet flow channel 254 may flow into the carbon dioxide inlet pipe 255. The purified water and carbon dioxide which flow through the purified water inlet pipe 253 and the carbon dioxide inlet pipe 255 may be injected into the mixing container 170 to prepare carbonated water.

The purified water inlet pipe 253 and the carbon dioxide inlet pipe 255 may be coupled with the preparing module body 260. In detail, the mounting body 272 may be formed on one side of the preparing module body 260, and the purified water inlet pipe 253 and the carbon dioxide inlet pipe 255 may be coupled with the other side of the preparing module body 260. In more detail, the mounting body 272 may be formed on a second module body 271, and the purified water inlet pipe 253 and the carbon dioxide inlet pipe 255 may be coupled with a first module body 261.

The first dispenser assembly 200 may include one or more relief valves 150 and a drainage module 160.

The relief valve 150 may externally discharge purified water or carbonated water which overflows when purified water exceeding a predetermined amount is supplied to the mixing container 170 or carbonated water exceeding a predetermined amount is prepared in the mixing container 170 in the carbonated water preparing process.

The relief valve 150 may be provided to be coupled with the preparing module body 260 of the carbonated water preparing module 250. In more detail, one end of the relief valve 150 is provided to be connected to an inside of the mixing container 170 when the mixing container 170 is mounted on the carbonated water preparing module 250 and the other end of the relief valve 150 is provided to be connected to the drainage module 160. Carbonated water or high-pressure carbon dioxide discharged through the relief valve 150 may flow into the drainage module 160.

The drainage module 160 may discharge carbonated water which overflows the mixing container 170 while taking a detour around the mixing container 170. The drainage module 160 may be provided to surround an outlet portion of the relief valve 150.

The carbonated water preparing module 250 may include the nozzle module 280. The nozzle module 280 may inject carbon dioxide into the mixing container 170. The nozzle module 280 may operate due to carbon dioxide which is supplied form the carbon dioxide supply module 220 and flows into the carbonated water preparing module 250. Components and operations of the nozzle module 280 will be described below in detail.

As shown in FIG. 8, the preparing module body 260 may include the first module body 261 and the second module body 271.

The first module body 261 may be coupled with the purified water inlet pipe 253 and the carbon dioxide inlet pipe 255. A nozzle movement portion 262 is installed in the first module body 261 to allow the nozzle module 280 to move. The nozzle movement portion 262 is installed inside the carbon dioxide inlet pipe 255 to allow the nozzle module 280 to move due to carbon dioxide which flows through the carbon dioxide inlet pipe 255.

A top of the second module body 271 may be coupled with a bottom of the first module body 261, and the mounting body on which the mixing container 170 is mountable may be formed below the second module body 271. In other words, the mixing container 170 may be coupled with or separated from the second module body 271.

In accordance with an embodiment, a stopper 271*b* may be installed on the second module body 271 to limit a movement of the nozzle module 280. The stopper 271*b* may be provided on a top surface of the second module body 271 and may limit the movement of the nozzle module 280 which moves due to the nozzle movement portion 262. In detail, the stopper 271*b* is provided to limit a movement of a nozzle pipe 282 to a supply enabled position P2 when carbon dioxide is supplied to the carbonated water preparing module 250.

The first module body 261 and the second module body 271, for example, may be fastened through coupling bolts 263*a* and coupling nuts 263*b*. However, a method of fastening the same is not limited thereto, and for example, may be fastened using epoxy adhesives.

FIGS. 9 to 12 are views of the nozzle module.

The nozzle module 280 may move due to carbon dioxide which flows into the carbonated water preparing module 250 and may directly inject carbon dioxide into the mixing container 170. In this case, the nozzle module 280 may directly inject carbon dioxide below the surface of purified water stored in the mixing container 170. Depending on embodiments, carbon dioxide may be injected just below the surface of the purified water. Accordingly, the injected carbon dioxide may be in direct contact with the purified water and may more easily dissolve in the purified water.

In accordance with an embodiment, the nozzle module 280 may include the nozzle pipe 282 and a valve portion 290.

The nozzle pipe 282 is installed in the nozzle movement portion 262 to be movable. A carbon dioxide injection nozzle 286 is formed at one end of the nozzle pipe 282. Carbon dioxide which flows into the other end thereof may be injected through the carbon dioxide injection nozzle 286. The nozzle pipe 282 may include a nozzle pipe flow channel 282*a* through inside of which carbon dioxide flows.

The valve portion 290 is formed at the other end of the nozzle pipe 282. The valve portion 290 may include an inlet hole 291 and a valve portion 292. Carbon dioxide may flow from the inside of the carbonated water preparing module 250 to the nozzle pipe 282 through the inlet hole 291. The valve portion 292 may control an inflow of carbon dioxide by opening and closing the inlet hole 291. The valve portion 292 may induce an inflow of carbon dioxide by opening the inlet hole 291 when a pressure inside the carbon dioxide inlet pipe 255 exceeds a predetermined level. Because the valve portion 290 is provided at the other end of the nozzle pipe 282, when an applied pressure of carbon dioxide is less than a predetermined level, the other end of the nozzle pipe 282 is closed by the valve portion 290.

The valve portion 290 may include a valve housing 293. The inlet hole 291 may be formed in the valve housing 293. The valve portion 292 may be located inside the valve housing 293. The valve housing 293 is provided to be coupled with the nozzle pipe 282 to allow the valve portion 292 therein to move in the valve housing 293 without deviating to the outside.

The nozzle module 280 may move among a standby position P1, the supply enabled position P2, and a supply position P3.

The standby position P1 refers to a position of the nozzle module 280 when carbon dioxide is not supplied form the carbon dioxide supply module 220 or the pressure inside the carbon dioxide inlet pipe 255 is less than a first pressure even through carbon dioxide is supplied. When the nozzle module 280 is located in the standby position P1, the carbon dioxide injection nozzle 286 may be disposed above the surface of the purified water stored in the mixing container 170.

The supply enabled position P2 refers to a position to which the nozzle module 280 moves when carbon dioxide is supplied form the carbon dioxide supply module 220 to the carbon dioxide inlet pipe 255 of the carbonated water preparing module 250 and thus the pressure inside the carbon dioxide inlet pipe 255 is the first pressure. In this case, the carbon dioxide injection nozzle 286 may move to be located below the surface of the purified water stored in the mixing container 170.

The supply position P3 refers to a position to which the nozzle module 280 moves when carbon dioxide is supplied form the carbon dioxide supply module 220 to the carbon dioxide inlet pipe 255 of the carbonated water preparing module 250 and thus the pressure inside the carbon dioxide inlet pipe 255 increases to a second pressure higher than the first pressure. In this case, the carbon dioxide injection nozzle 286 may inject carbon dioxide.

In accordance with an embodiment, the nozzle module 280 may include a nozzle elastic member 284. The nozzle elastic member 284 may elastically support the nozzle pipe 282 and may be provided to surround the nozzle pipe 282. In this case, the nozzle elastic member 284 may be disposed to allow one end thereof to be supported by the valve portion 290 and the other end thereof to be supported by the stopper 271*b* of the second module body 271. The nozzle elastic member 284 may elastically support the nozzle pipe 282 to allow the nozzle module 280 to be maintained in the standby position P1 until the pressure of carbon dioxide inside the carbon dioxide inlet pipe 255 becomes the first pressure. When the pressure of carbon dioxide inside the carbon dioxide inlet pipe 255 becomes the first pressure, the nozzle elastic member 284 is compressed, thereby moving the nozzle pipe 282 until limited by the stopper 271*b*. Accordingly, the nozzle module 280 is moved to the standby position P1 to the supply enabled position P2.

In accordance with an embodiment, the valve portion 290 may include a valve elastic member 294. The valve elastic member 294 elastically supports the valve portion 292. In this case, the valve elastic member 294 may be provided to allow one end thereof to be supported by the valve portion 292 and the other end thereof to be supported by the nozzle pipe 282. The valve elastic member 294 may elastically support the valve portion 292 to allow the nozzle module 280 to move from the supply enabled position P2 to the supply position P3 when the pressure of carbon dioxide inside the carbon dioxide inlet pipe 255 is the second pressure. Accordingly, the valve elastic member 294 may elastically support the valve portion 292 to allow the nozzle module 280 to be maintained in the supply enabled position P2 when the pressure inside the carbon dioxide inlet pipe 255 is less than the second pressure. Because the second pressure is higher than the first pressure, an elastic force of the valve elastic member 294 may be provided to be greater than an elastic force of the nozzle elastic member 284.

When the pressure of carbon dioxide inside the carbon dioxide inlet pipe 255 becomes the second pressure, the valve elastic member 294 is compressed, and accordingly, the valve portion 292 opens the inlet hole 291. The carbon dioxide of the carbon dioxide inlet pipe 255 may pass through the opened inlet hole 291, may flow along the nozzle pipe flow channel 282*a*, and may be discharged through the carbon dioxide injection nozzle 286 located below the surface of the purified water inside the mixing container 170.

As described above, because the injection nozzle 286 may directly inject carbon dioxide below the surface of the purified water stored in the mixing container 170, the solubility of the carbon dioxide may be improved, thereby increasing the efficiency of preparing carbonated water.

When supplying of carbon dioxide from the carbon dioxide supply module 220 stops, the compressed valve elastic member 294 and the nozzle elastic member 284 are restored to original states, and accordingly, the nozzle module 280 moves from the supply position P3 to the standby position P1.

The first pressure and the second pressure described above may be variably set. However, the second pressure may be set to be higher than the first pressure. For example, the first pressure may be set as 0.5 bar and the second pressure may be set as 1.5 bar. However, the first pressure and the second pressure are not limited thereto but may be variably set depending on a carbonated water preparing environment or an arbitrary selection by a designer.

Figure 13:
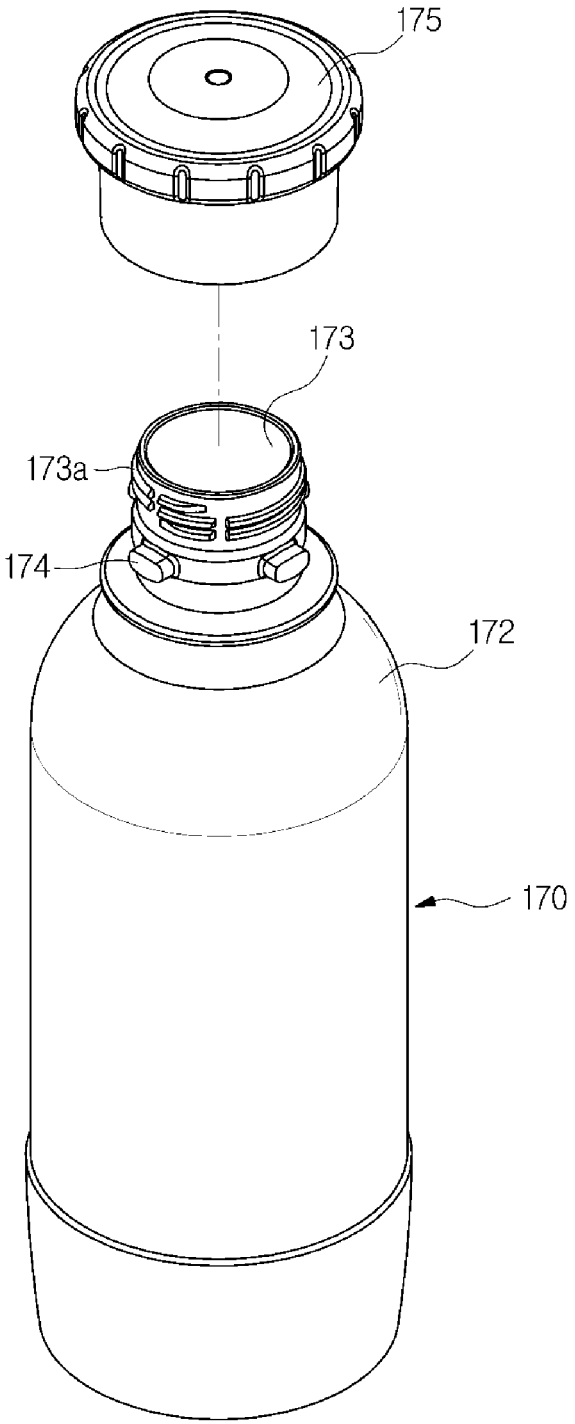
FIG. 13 is a view of the mixing container.

FIG. 13 is a view of the mixing container.

As shown in FIG. 13, the mixing container 170 may include a container body 172 capable of storing a liquid therein and an opening 173 through which the liquid may flow from the container body 172 in or be discharged.

Figure 14:
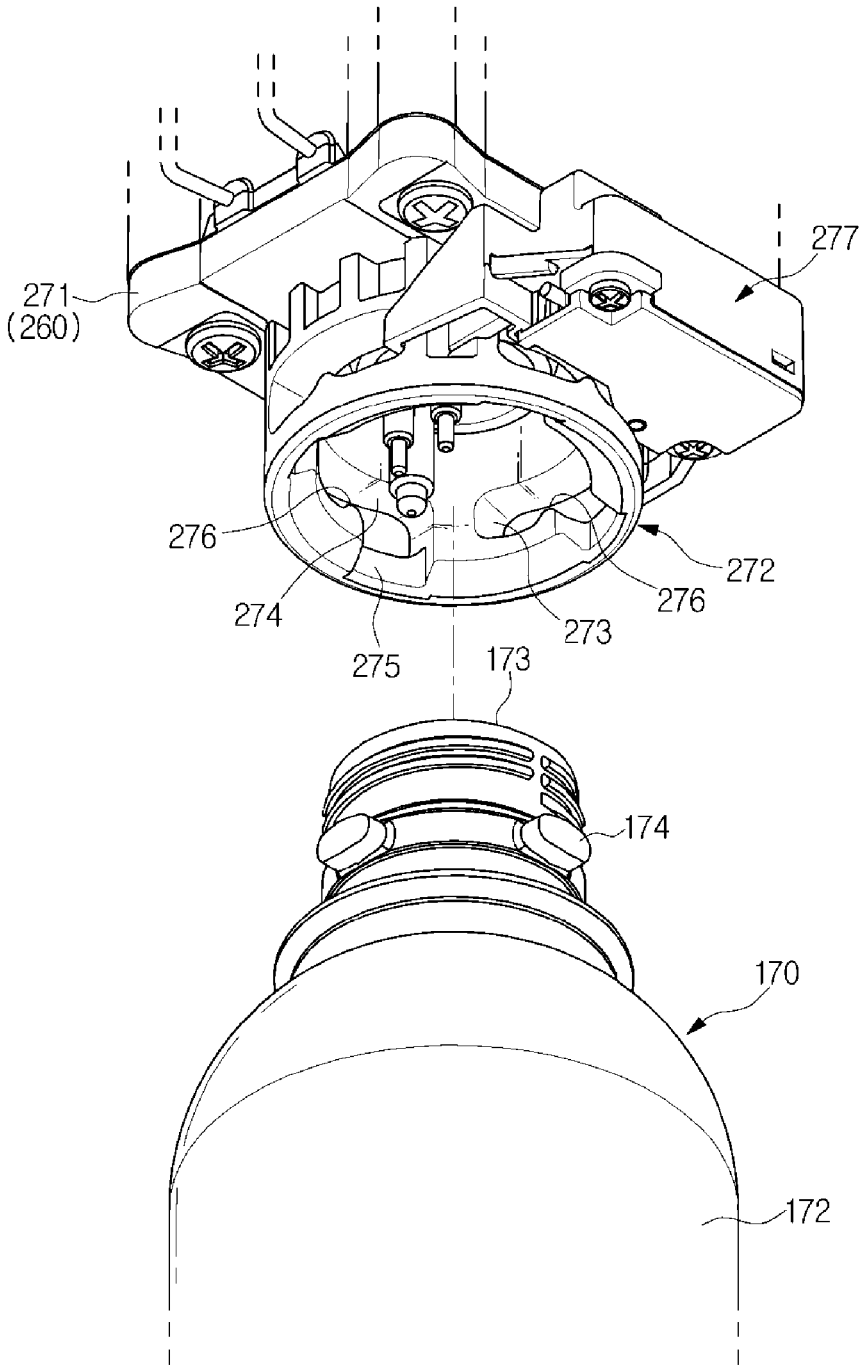
FIGS. 14, 15, and 16 are views illustrating an example of mounting the mixing container in the carbonated water preparing module.

The container body 172, as shown in FIG. 14, may have a cylindrical shape. However, the shape of the container body 172 is not limited thereto but may have a hexahedral shape or may have various shapes according to user's preference.

The opening 173 may be provided on one side of the container body 172. In accordance with an embodiment, a protruding portion 173*a* may be formed on one end of the container body 172, and the opening 173 may be formed on one end of the protruding portion 173*a*.

The opening 173 of the container body 172 may have an approximate circular shape. Depending on embodiments, the shape of the opening 173 may be provided corresponding to the shape of the container body 172.

The mixing container 170 may have one or more mounting protrusions 174 which protrude from the container body 172. The mounting protrusion 174 may be provided adjacent to the opening 173 and may be formed on the protruding portion 173*a* depending on embodiments. The mounting protrusions 174 may be formed to radially protrude around the opening 173. When a plurality of such mounting protrusions 174 are formed, the mounting protrusions 174 may be formed on the container body 172 spaced apart at predetermined intervals. When the mixing container 170 is mounted on the mounting body 272, the opening 173 is inserted into the mounting body 272, and the mounting protrusions 174 may be mounted in a mounting portion 273 of the mounting body 272.

The mixing container 170 may be provided to be easily portable after separating from the mounting body 272. For this, the mixing container 170 may further include a handle (not shown) to allow the user to easily grip.

Also, a cover 175 capable of opening and closing the opening 173 may be mounted on the one end of the mixing container 170.

Figure 15:
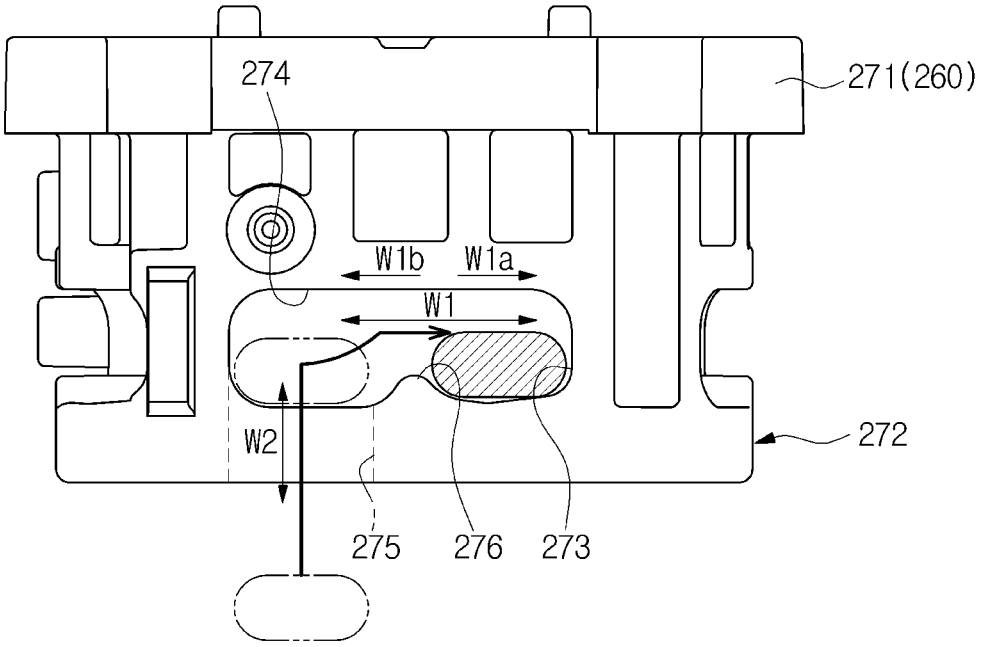
Figure 16:
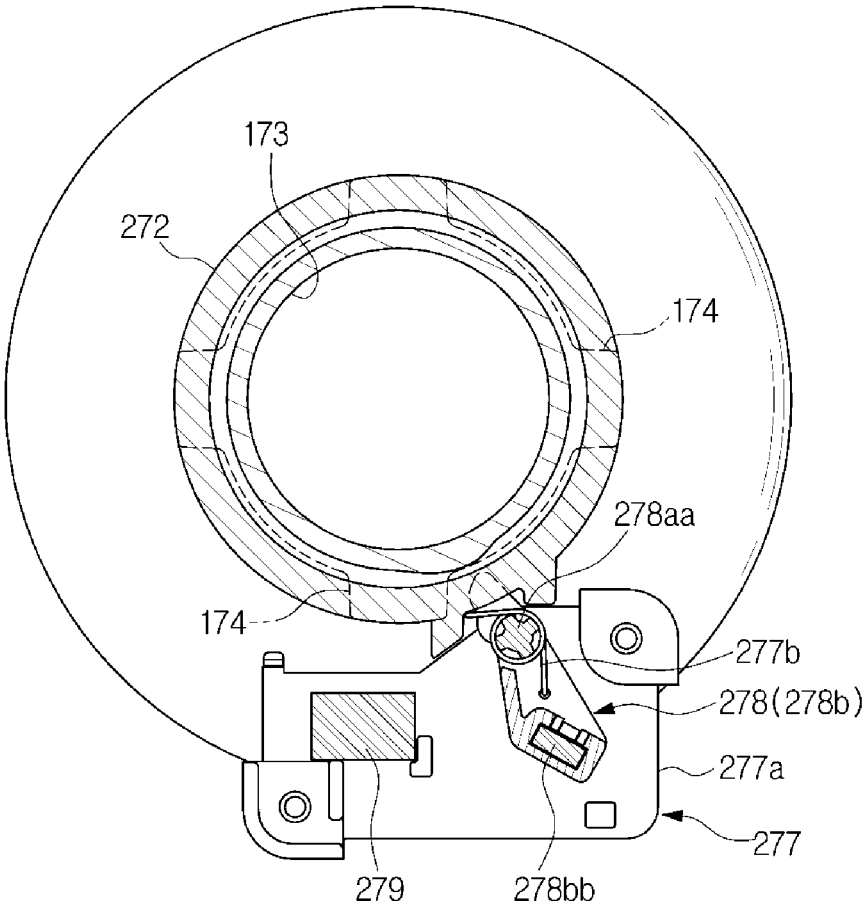
Figure 17:
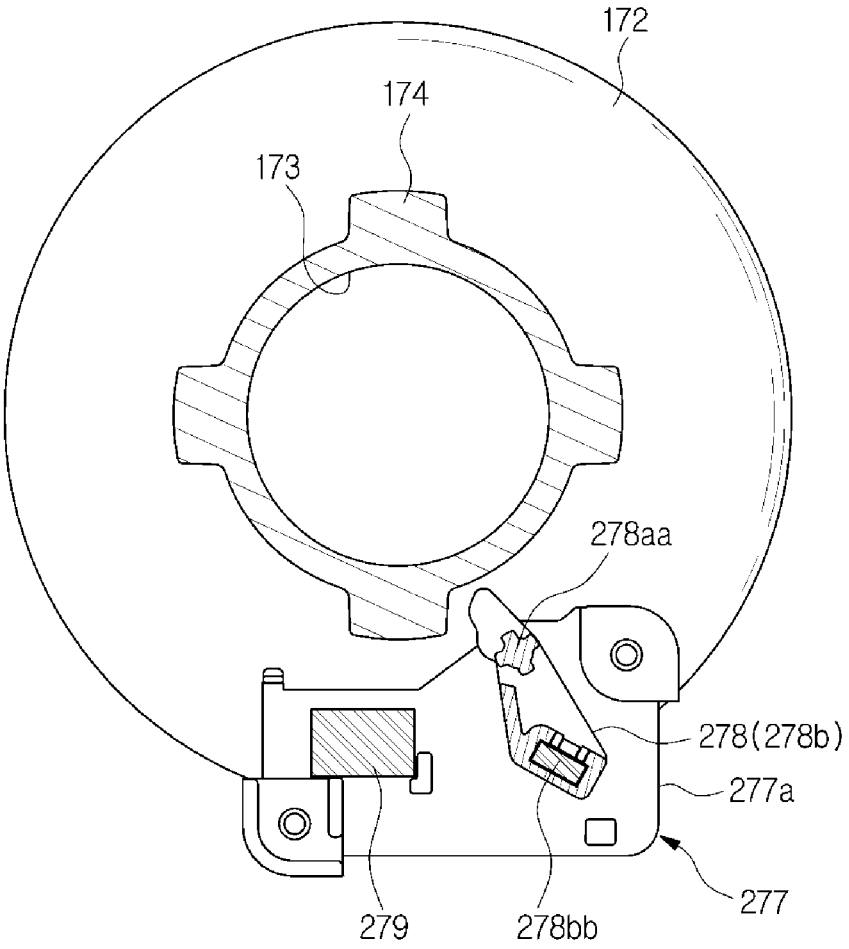
FIGS. 17, 18, and 19 are views illustrating a process of sensing the mounting of the mixing container.
Figure 18:
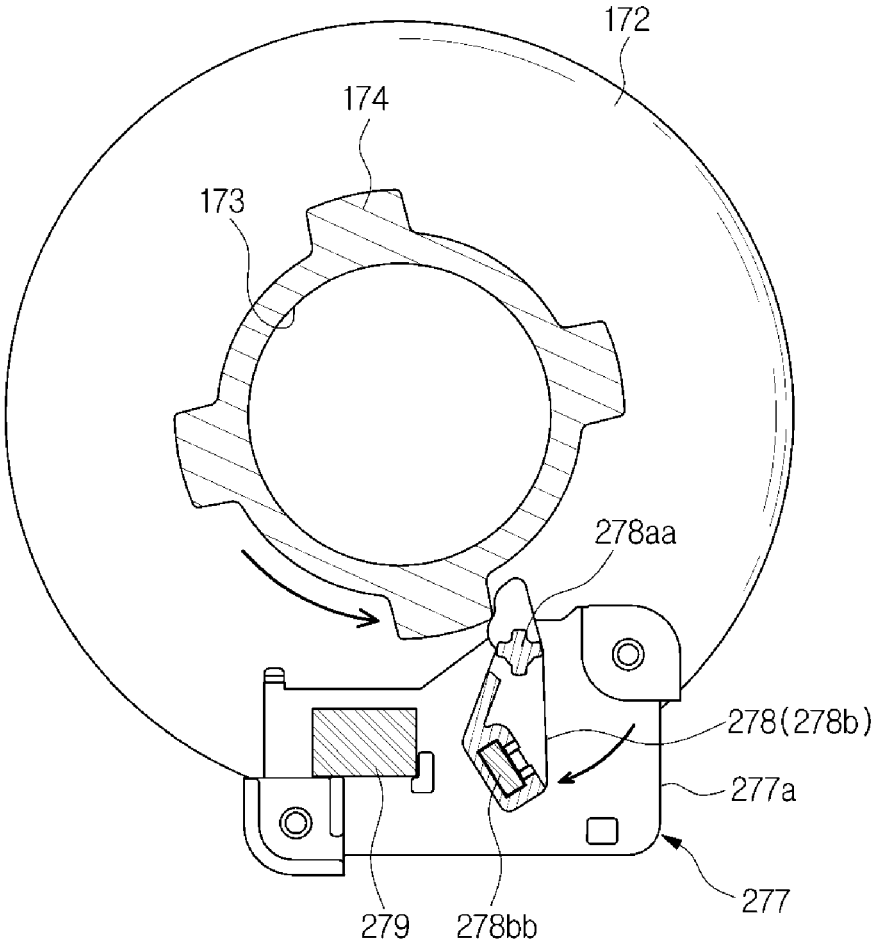
Figure 19:
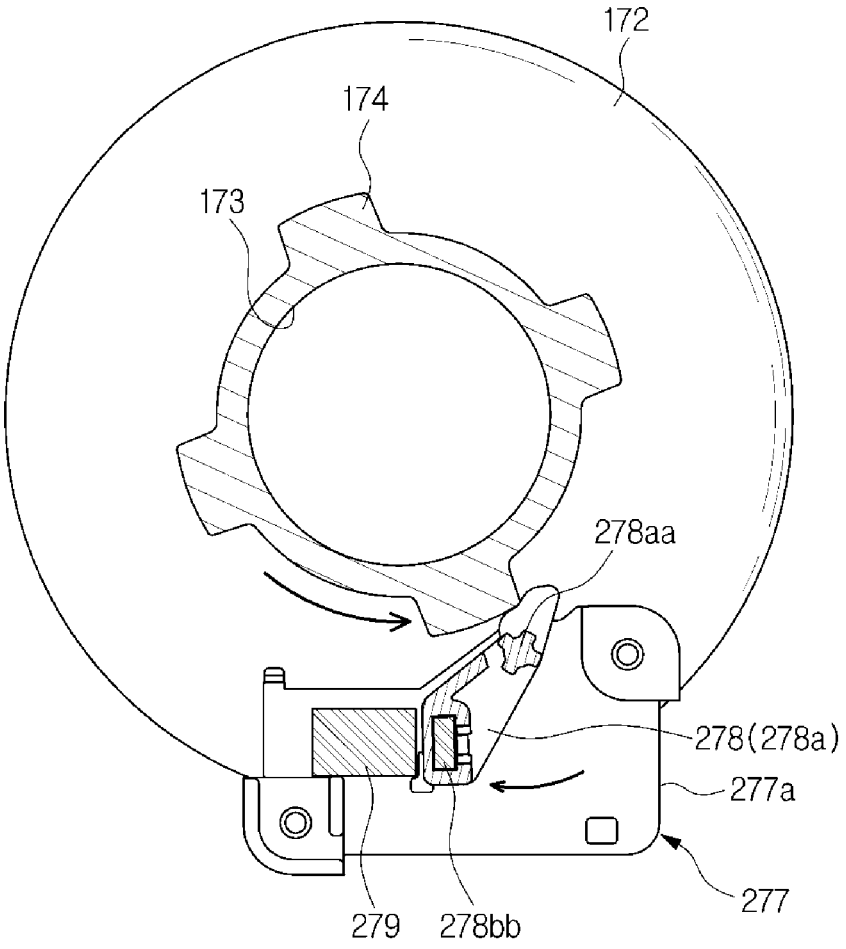

FIGS. 14 to 16 are views illustrating an example of mounting the mixing container in the carbonated water preparing module.

As shown in FIGS. 14 to 16, the preparing module body 260 may further include the mounting body 272 on which the mixing container 170 is mounted and the mounting sensor 277 which senses whether the mixing container 170 is coupled with the mounting body 272.

The mounting body 272 may include the mounting portion 273 in which the mounting protrusion 174 is mounted and a guide rail 274 which guides the mounting protrusion 174 to the mounting portion 273.

The mounting portion 273 may have a shape corresponding to a shape of the mounting protrusion 174, and thus the mounting protrusion 174 may be stably mounted in the mounting portion 273.

The guide rail 274 may be formed extending from the mounting portion 273 and may have a predetermined shape to allow the mounting protrusion 174 to easily move to the mounting portion 273, according to routes W1 and W2. When the mounting body 272 has a cylindrical shape, the guide rail 274 may be formed along an inner circumferential surface of the mounting body 272 corresponding to the mounting protrusion 174.

The mounting protrusion 174 may move along the guide rail 274 in a separation direction W1*b* or a mounting direction W1*a*. Here, the mounting direction refers to a direction in which the mounting protrusion 174 moves toward the mounting portion 273 along the guide rail 274, and the separation direction refers to a direction in which the mounting protrusion 174 moves away from the mounting portion 273 along the guide rail 274. The separation direction or the mounting direction may be arbitrarily determined depending on a selection by the designer.

As described above, when the plurality of mounting protrusions 174 are provided on the mixing container 170 while being spaced apart, a plurality of such guide rails 274 may also be provided on the mounting body 272 to be spaced apart.

In accordance with an embodiment, the mounting body 272 may include an insertion groove 275. The insertion groove 275 allows the mounting protrusion 174 to be located in the guide rail 274 when the mixing container 170 is inserted into the mounting body 272. The insertion groove 275 may be formed extending from the guide rail 274 and may be formed on the mounting body 272 along a direction in which the mixing container 170 is inserted into the mounting body 272.

In accordance with an embodiment, the mounting body 272 may include a detachment preventing protrusion 276. The detachment preventing protrusion 276 may be formed on the guide rail 274 while being adjacent to the mounting portion 273 to prevent the mounting protrusion 174 located in the mounting portion 273 from being detached from the mounting portion 273.

The mounting sensor 277 may sense that the mixing container 170 is mounted on the mounting body 272. In accordance with an embodiment, the mounting sensor 277 may sense that the mounting protrusion 174 moves to the mounting portion 273 along the guide rail 274 of the mounting body 272, that the mounting protrusion 174 passes the detachment preventing protrusion 276, that the mounting protrusion 174 is mounted on the mounting portion 273, or that the mounting protrusion 174 moves in the insertion groove 275. Depending on embodiments, the mounting sensor 277 may sense all the above cases.

In accordance with an embodiment, the mounting sensor 277 may include a sensing lever 278 and a sensor portion 279.

The sensing lever 278 may be provided pivotable. In detail, the sensing lever 278 may pivot around a sensing lever central axis 278*aa* and may be provided to be pivotable due to a pressure applied when the mounting protrusion pressurizes one side thereof. The sensing lever 278 may pivot and move between an unmount position 278*b* and a mount position 278*a*. Here, the unmount position 278*b* refers to a position corresponding to when the mounting protrusion 174 is located on the guide rail 274 and the mount position 278*a* refers to a position corresponding to when the mounting protrusion 174 moves on the guide rail 274 and arrives at the mounting portion 273.

In accordance with an embodiment, the mounting sensor 277 may include a return elastic member 277*b*. The return elastic member 277*b* may allow the sensing lever 278 to return from the mount position 278*a* to the unmount position 278*b* when the mixing container is separated from the mounting body 272.

The sensor portion 279 may sense turning of the sensing lever 278. The sensor portion 279 is provided corresponding to the other side of the sensing lever 278 to sense the turning of the sensing lever 278.

In accordance with an embodiment, a magnet 278*bb* may be formed on the other side of the sensing lever 278 and the sensor portion 279 may include a reed switch provided to sense the magnet 278*bb* of the sensing lever 278. In accordance with an embodiment, the sensor portion 279, for example, may include a micro switch which is turned on/off by being pressurized by the other side of the sensing lever 278.

In accordance with an embodiment, the mounting sensor 277 may include a sensor housing 277*a*. The sensor housing 277*a* may prevent the sensing lever 278 and the sensor portion 279 from being exposed to the outside. Also, the sensor housing 277*a* may prevent the sensing lever 278 and the sensor portion 279 from malfunctioning due to purified water.

When the mixing container 170 is mounted on the mounting body 272, the opening 173 of the mixing container 170 may be airtight due to the carbonated water preparing module 250. In this case, the opening 173 of the mixing container 170 may be airtight due to the preparing module body 260 or an additional component.

For example, the carbonated water preparing module 250 may include a packing portion 271*a* to allow the opening 173 of the mixing container 170 to be airtight. The packing portion 271*a* may be disposed corresponding to the opening 173 of the mixing container 170 inside the mounting body 272. The packing portion 271*a* may allow the opening 173 to be airtight to prevent carbonated water from flowing out through the opening 173 when the mixing container 170 is mounted on the mounting body 272.

FIGS. 16 to 19 are views illustrating a process of sensing the mounting of the mixing container.

Referring to FIGS. 16 to 19, an operation of mounting the mixing container 170 on the carbonated water preparing module 250 will be described.

When the mixing container 170 is mounted on the mounting body 272 exposed to the mixing space 132, the mounting protrusion 174 of the mixing container 170 may be inserted into the guide rail 274 along the insertion groove 275.

When the mixing container 170 is inserted into the mounting body 272, the mixing container 170 may be rotated in the mounting direction. In this case, the mounting protrusion 174 moves along the guide rail 274 in the mounting direction and is finally located in the mounting portion 273, thereby mounting the mixing container 170 on the mounting body 272.

When the mixing container 170 is rotated in the mounting direction, the sensing lever 278 of the mounting sensor 277 is pressurized by the mounting protrusion 174 in the unmount position 278*b* and moves to the mount position 278*a*, and the sensor portion 279 senses whether the mixing container 179 is mounted by sensing the movement of the sensing lever 278. Accordingly, whether the mixing container 170 is mounted on the carbonated water preparing module 250 may be sensed. When the movement of the sensing lever 278 is sensed, the sensor portion 279 may output and transmit a predetermined electrical signal to processor 300 (refer to FIG. 20).

The processor 300 provided in the refrigerator 1 may determine that the mixing container 170 is mounted on the mounting body 272 based on the electrical signal transmitted from the sensor portion 279 and may control respective components for preparing of carbonated water in the mixing container 170. Then, purified water is supplied into the mixing container 170 and carbon dioxide is injected into the purified water, thereby preparing carbonated water.

Here, the processor 300 may be embodied using one or more semiconductor chips and related components provided on a printed circuit board installed in the refrigerator 1. The processor 300 may include a micro control unit (MCU).

When the mixing container 170 is incorrectly mounted on the mounting body 272, the mounting protrusion 174 is not inserted into the guide rail 274. When the mounting protrusion 174 is not mounted in the mounting portion 273, because the mounting sensor 277 is maintained in the unmount position 278*b*, the sensor portion 279 may not sense the mounting of the mixing container 170.

In this case, the processor 300 provided in the refrigerator 1 may determine that the mixing container 170 is not mounted on the mounting body 272 and may stop the preparing of carbonated water in the mixing container 170. As a result, when the mixing container 170 is incorrectly mounted or not mounted, carbonated water is not prepared, thereby increasing the stability of preparing carbonated water and improving safety of the user also.

On the other hand, to separate the mixing container 170 from the carbonated water preparing module 250, the mixing container 170 is rotated in the separation direction. Then, the mounting protrusion 174 of the mixing container 170 moves from the mounting portion 273 along the guide rail 274 and arrives at the insertion groove 275. When the mounting protrusion 174 is moved away from the mounting body 272 through the insertion groove 275, the mixing container 170 may be separated from the carbonated water preparing module 250.

In this case, the sensing lever 278 of the mounting sensor 277 moves from the mount position 278*a* to the unmount position 278*b* as the pressure applied from the mounting protrusion 174 is removed.

The sensor portion 279 may sense that the sensing lever 278 moves to the unmount position 278*b* and may output an electrical signal corresponding thereto. The processor 300 may determine whether the mixing container 170 is detached based on the electrical signal transmitted from the sensor portion 279 and may stop preparing of carbonated water by transmitting control signals to each component depending on a determination result.

Depending on embodiments, the sensor portion 279 may continuously output an electrical signal when the sensing lever 278 is located in the mount position 278*a* and may stop outputting of the electrical signal when the sensing lever 278 moves to the unmount position 278*b*. In this case, the processor 300 may determine whether the mixing container 170 is detached according to a stop of the electrical signal transmitted from the sensor portion 279 and may stop preparing of carbonated water by transmitting control signals to each component depending on the determination result.

Hereinafter, referring to FIGS. 20 to 23, the user interface 40 provided in the refrigerator 1 and an example of an operation of the user interface 40 will be described.

Figure 20:
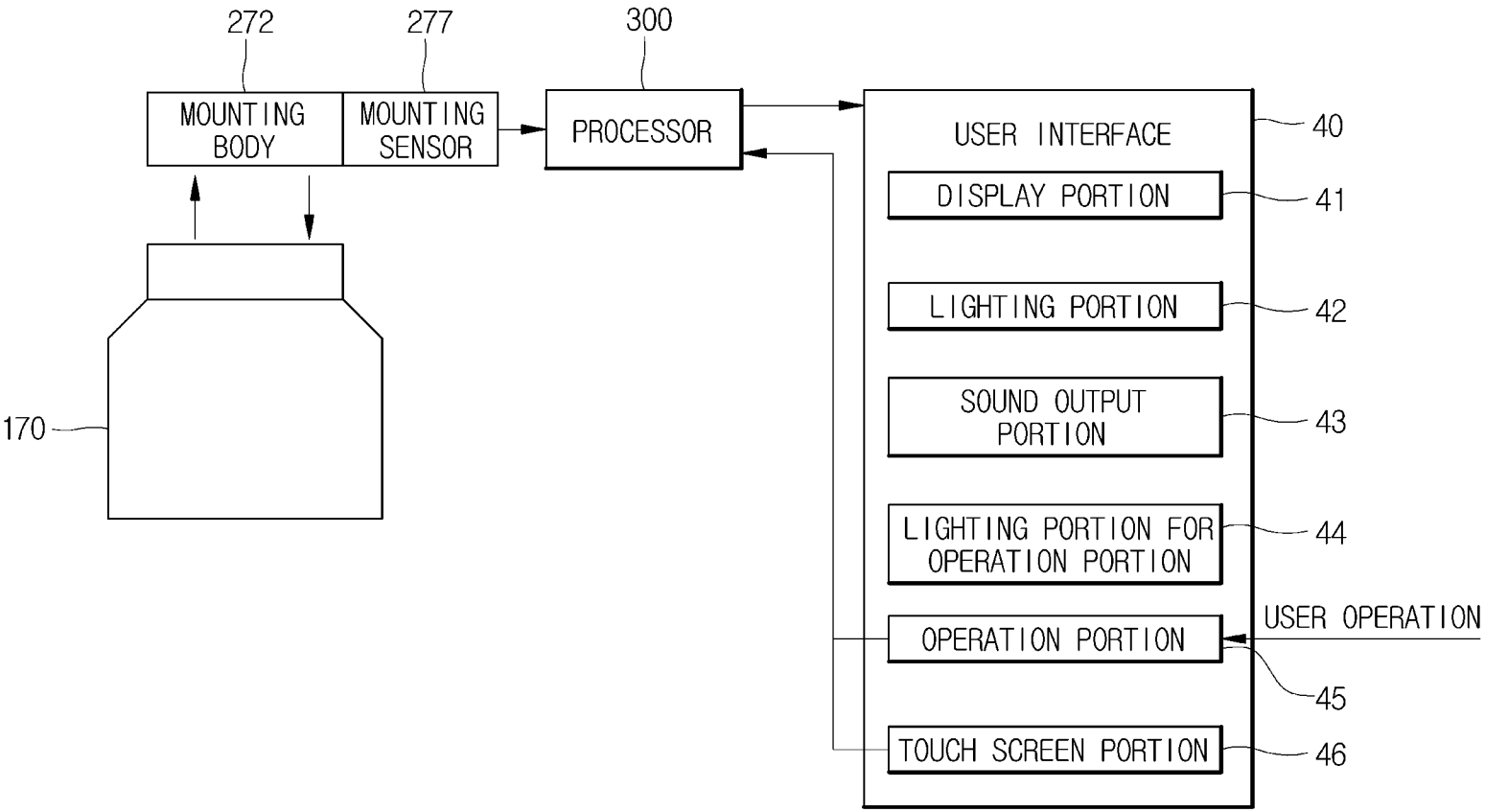
FIG. 20 is a block diagram of the refrigerator in accordance with an embodiment of the present disclosure.

As shown in FIG. 20, the refrigerator 1 may include the mixing container 170 in which carbon dioxide and purified water are mixed and carbonated water is prepared, the mounting body 272 on which the mixing container 170 is mountable or detachable, the mounting sensor 277 which senses whether the mixing container 170 is mounted on the mounting body 272, the processor 300 which receives an electrical signal output from the mounting sensor 277 and generates a control signal according thereto, and the user interface 40 which displays various pieces of information under the control of the processor 300 or receives a command from the user.

Because the mixing container 170, the mounting body 272, and the mounting sensor 277 have already been described above, a detailed description thereof will be omitted.

The processor 300 may control the overall operations of the refrigerator 1. The processor 300 may generate control signals for each of the components of the refrigerator 1 based on an electrical signal output from the mounting sensor 277, the operation portion 45, or a touch screen portion 46 and may transmit the generated control signals to each of the components.

The processor 300 may determine whether the mixing container 170 is mounted on the mounting body 272 based on the electrical signal output from the mounting sensor 277, may generate a control signal based on a determination result, and may transmit the control signal to the user interface 40.

For example, when the sensing lever 278 of the mounting sensor 277 moves to the mount position 278*a* and thus the sensor portion 279 outputs an electrical signal according to the position of the sensing lever 278 at the mount position 278*a*, the processor 300 may receive the output electrical signal and may determine that the mixing container 170 is mounted on the mounting body 272 by analyzing the received electrical signal.

Conversely, when the sensing lever 278 of the mounting sensor 277 moves to the unmount position 278*b* and thus the sensor portion 279 outputs an electrical signal according to the movement of the sensing lever 278 to the unmount position 278*b*, the processor 300 may receive the output electrical signal and may determine that the mixing container 170 is not mounted on the mounting body 272 by analyzing the received electrical signal. In other words, the processor 300 may determine that the mixing container 170 is detached from the mounting body 272.

The processor 300 may generate a control signal corresponding to a determination result and may transmit the generated control signal to the user interface 40.

The user interface 40, as described above, may provide various pieces of information related to the refrigerator 1 to the user or may receive various commands related to the control of the refrigerator 1 from the user.

The user interface 40, depending on embodiments, may include at least one of the display portion 41, the lighting portion 42, a sound output portion 43, a lighting portion 44 for the operation portion 45, the operation portion 45, and the touch screen portion 46.

The display portion 41 may display various pieces of information related to the refrigerator 1. For example, the display portion 41 may display various pieces of information such as whether the refrigerator 1 operates, temperatures of the storage compartments 20 and 30 of the refrigerator 1, operation modes of each of the storage compartments 20 and 30, whether a malfunction of the refrigerator 1 has occurred, various pieces of daily information necessary for the user including news, weather, etc.

In accordance with an embodiment, the display portion 41 may display various pieces of information related to preparing of carbonated water including whether preparing of carbonated water begins, whether purified water is supplied to the mixing container 170, whether carbon dioxide is supplied to the mixing container 170, whether preparing of carbonated water is completed, the concentration of carbon dioxide in carbonated water already prepared or to be prepared, etc.

The display portion 41 may display mounting information which indicates that the mixing container 170 is coupled with the mounting body 272 when the mixing container 170 is coupled with the mounting body 272. In this case, the display portion 41 may display the mounting information according to a control signal transmitted from the processor 300 and may display the mounting information using letters, symbols, numbers, or figures as defined in advance. The display portion 41 may display the mounting information using a still image and may display the mounting information using a moving image. The still image or moving image displayed by the display portion 41 may be preset by the designer or may be set by the user. The still image or moving image described above may be arbitrarily changed by the user.

As described above, the user may determine whether the mixing container 170 is properly mounted on the mounting body 272 using the mounting information provided through the display portion 41. Accordingly, user's convenience in mounting the mixing container 170 may be improved.

Also, the display portion 41 may display detachment information which indicates that the mixing container 170 is detached from the mounting body 272 when the mixing container 170 is detached from the mounting body 272. In this case, the display portion 41 may also display the detachment information according to a control signal transmitted from the processor 300. The detachment information may be displayed using letters, symbols, numbers, or figures different from those of the mounting information. Depending on embodiments, the display portion 41 may display the detachment information using a still image and may display the detachment information using a moving image. The still image or moving image displayed by the display portion 41 as described above may be preset by the designer or may be set by the user. The still image or moving image described above may be arbitrarily changed by the user.

The display portion 41 may be embodied using various devices capable of displaying images including a light emitting diode (LED), a liquid crystal display (LCD), a plasma display panel (PDP), etc.

The display portion 41 may display various pieces of information related to the refrigerator 1 by outputting light. For example, when an anticipated situation occurs, for example, the refrigerator 1 performs a predetermined operation or the refrigerator 1 malfunctions, the lighting portion 42 may output light to inform or warn the user of the current state of the refrigerator 1.

The lighting portion 42 may output various colors of light. Here, a color of output light may be determined according to predefined settings. For example, the lighting portion 42 may be set to output red light when the refrigerator 1 malfunctions. Also, the lighting portion 42 may output light in various patterns. For example, the lighting portion 42 may output light in a pattern in which light repeatedly flickers in a short time. The pattern described above may be determined according to predefined settings.

In accordance with an embodiment, when the mixing container 170 is coupled with the mounting body 272, the lighting portion 42 may display the mounting information to the user by outputting a predetermined color of light in a predetermined pattern. Also, when the mixing container 170 is detached from the mounting body 272, the lighting portion 42 may display the detachment information to the user by outputting a predetermined color of light in a predetermined pattern. In this case, the display portion 41 may also display the mounting information or the detachment information according to a control signal transmitted from the processor 300. At least one of colors and output patterns of light to display the mounting information or the detachment information may be arbitrarily determined by the designer and may be determined or changed by the user as necessary. The color and output pattern of light to display the mounting information may be identical to or different from the color and output pattern of the detachment information.

The user may recognize at least one of the color and output pattern of light output by the lighting portion 42 and may determine whether the mixing container 170 is properly mounted on the mounting body 272.

The lighting portion 42 may be embodied using various light emitting devices such as an LED lamp, an incandescent lamp, and a fluorescent lamp.

The sound output portion 43 may output a predetermined sound. Here, the output sound may include a mechanical sound such as a beep, music, a human voice, or other various types of sounds. The sound output portion 43 may provide various pieces of information related to a state or operation of the refrigerator 1 by outputting a sound.

In accordance with an embodiment, when the mixing container 170 is coupled with the mounting body 272, the sound output portion 43 may provide the mounting information to the user by outputting a predetermined sound. Also, when the mixing container 170 is detached from the mounting body 272, the sound output portion 43 may provide the detachment information to the user by outputting a predetermined sound. The sound output portion 43 may also output the mounting information through a sound according to a control signal transmitted from the processor 300. Sounds corresponding to the mounting information and the detachment information may be identical to or different from each other and may be arbitrarily determined by the designer or the user. Sounds corresponding to the mounting information and the detachment information may be changed as necessary.

The user may easily determine whether the mixing container 170 is properly mounted on the mounting body 272 by hearing a sound output from the sound output portion 43.

The sound output portion 43 may be embodied using various types of speaker devices.

Figure 21A:
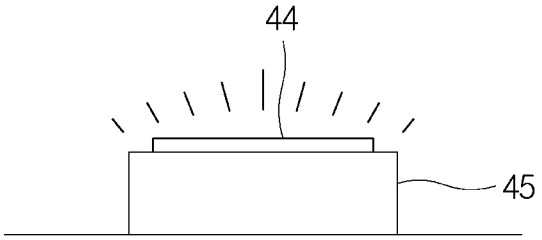
FIGS. 21A, 21B, and 21C are views illustrating examples of an operation portion and a lighting portion for the operation portion.
Figure 21B:
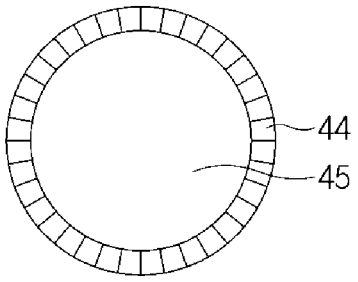
Figure 21C:
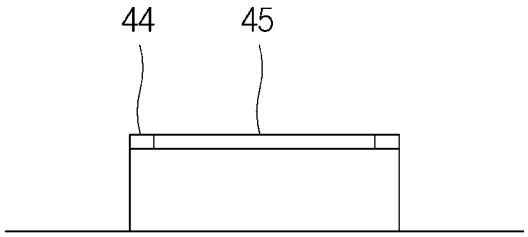

FIG. 21A to FIG. 21C are views illustrating examples of an operation portion and a lighting portion for the operation portion.

The operation portion 45 may receive various types of commands for controlling the refrigerator 1 from the user and may output and transmit a predetermined electrical signal to the processor 300 according to an operation of the user. The processor 300 may generate a control signal for controlling the refrigerator 1 based on the electrical signal transmitted from the operation portion 45.

The operation portion 45 may be embodied using various operation devices including a physical button, a knob, a track ball, a touch pad, a touch button, a track pad, a lever, a light sensor, a touch sensor, etc.

As shown in FIGS. 21A to 21C, the lighting portion 44 for the operation portion 45 may be provided on the operation portion 45 or around the operation portion 45.

The lighting portion 44 for the operation portion 45 may provide various types of information related to the refrigerator 1 to the user by outputting light from the operation portion 45 or the periphery of the operation portion 45.

The lighting portion 44 for the operation portion 45, like the lighting portion 42, may output various colors of light and a color of output light herein may be determined according to predefined settings. Also, the lighting portion 44 for the operation portion 45 may output light in various patterns.

In accordance with an embodiment, when the mixing container 170 is coupled with the mounting body 272, the lighting portion 44 for the operation portion 45 may display the mounting information to the user by outputting a predetermined color of light in a predetermined pattern. Also, when the mixing container 170 is detached from the mounting body 272, the lighting portion 44 for the operation portion 45 may display the detachment information to the user by outputting a predetermined color of light in a predetermined pattern. The lighting portion 44 for the operation portion 45 may also display the mounting information to the user by outputting a predetermined color of light in a predetermined pattern according to a control signal transmitted from the processor 300. At least one of the colors and output patterns of light may be arbitrarily determined by the designer and may be determined or changed by the user as necessary.

Depending on embodiments, as shown in FIG. 21A, the lighting portion 44 for the operation portion 45 may be disposed in the center of the operation portion 45 and may induce the user to operate the operation portion 45 by outputting light when the mixing container 170 is coupled with the mounting body 272.

Also, as shown in FIGS. 21B and 21C, depending on embodiments, the lighting portion 44 for the operation portion 45 may be disposed along an edge of the operation portion 45 and may induce the user to operate the operation portion 45 by outputting light when the mixing container 170 is coupled with the mounting body 272.

The lighting portion 44 for the operation portion 45 may be embodied using various light emitting devices such as an LED lamp, an incandescent lamp, and a fluorescent lamp.

Hereinafter, referring to FIGS. 22 and 23, an example of the user interface 40 will be described.

Figure 22:
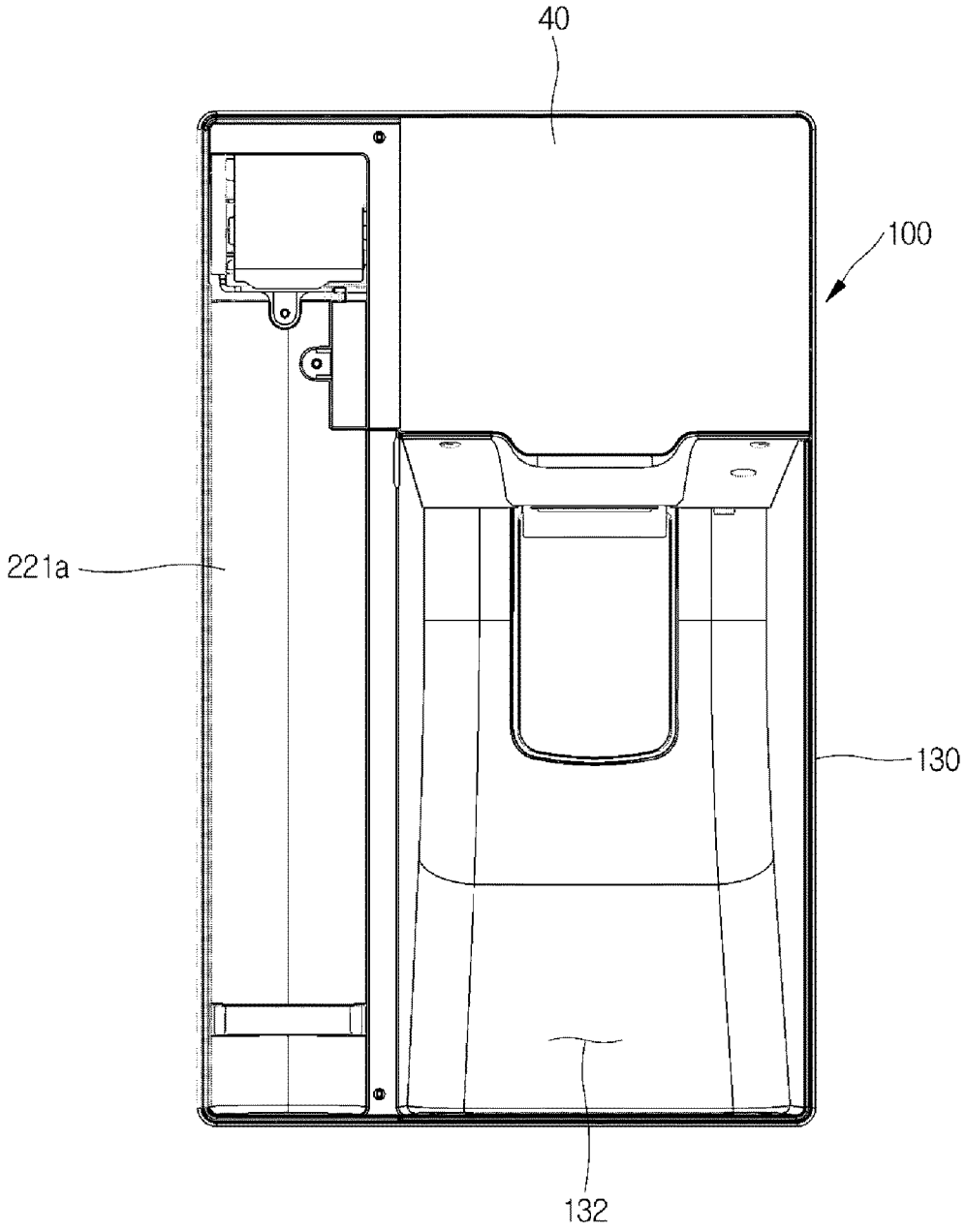
FIG. 22 is a front view of a dispenser assembly.
Figure 23:
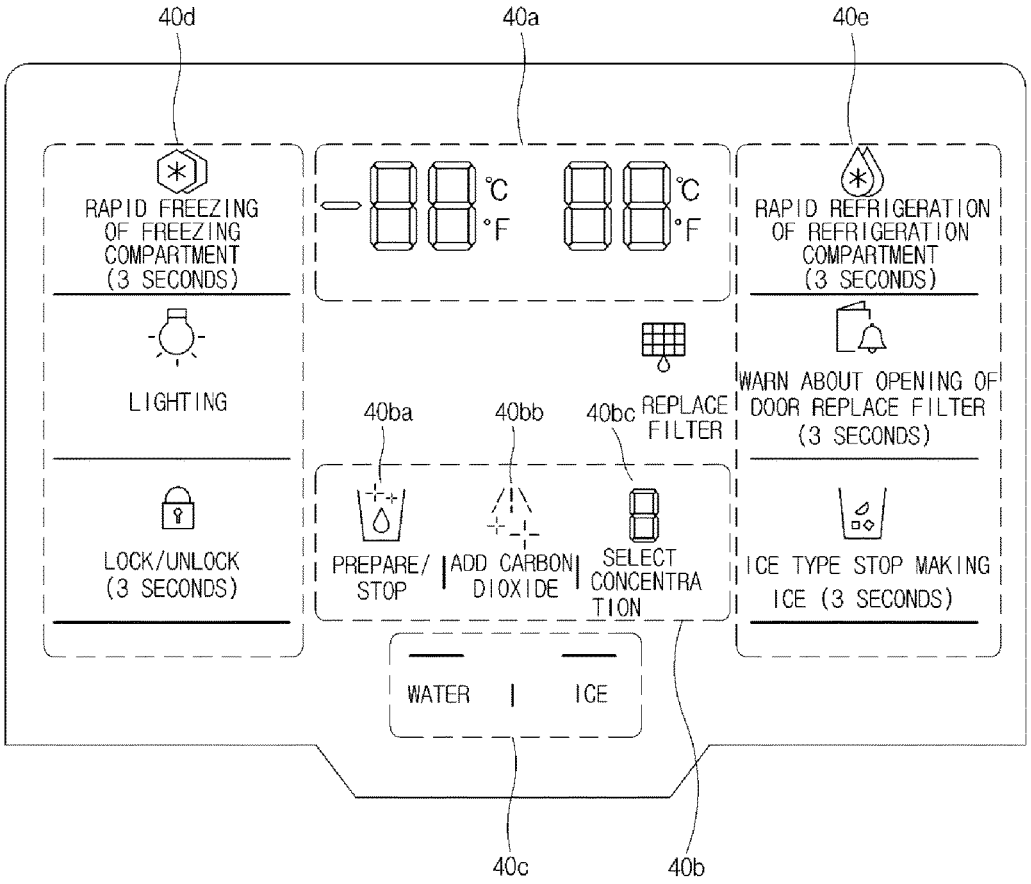
FIG. 23 is a view illustrating an example of a user interface.

FIG. 22 is a front view of a dispenser assembly 100. FIG. 23 is a view illustrating an example of a user interface.

Referring to FIG. 22, the user interface 40 may be installed on a part of the dispenser housing 130 of the dispenser assembly 100. Here, the user may easily check various states of the refrigerator 1 or a process of preparing carbonated water even while receiving carbonated water, ice, or purified water through the dispenser assembly 100.

In accordance with an embodiment, the user interface 40, as shown in FIG. 22, may be installed on the part of the dispenser housing 130 located above the mixing space 132. The cylinder door 221*a* which opens and closes the cylinder accommodation space 221 into which the carbon dioxide cylinder 222 can be inserted may be provided on a side portion of the user interface 40.

The user interface 40 may include a display section 40*a* for displaying various pieces of information including temperatures of the storage compartments 20 and 30, etc., a first operation section 40*b* in which an operation device capable of inputting various commands related to preparing of carbonated water is provided, a second operation section 40*c* in which an operation device for selecting one of water and ice supplied by the second dispenser assembly 110 is provided, and fourth operation sections 40*d* and 40*e* in which operation devices for inputting various other commands necessary for other operations of the refrigerator 1 are provided. Here, the operation devices of the respective operation sections 40*b*, 40*c*, 40*d*, and 40*e* may be embodied using physical buttons, touch sensors, etc.

The first operation section 40*b* may include at least one of a first operation portion 40*ba* which receives a command for starting preparing carbonated water, a second operation portion 40*bb* which receives a command for adding carbon dioxide, and a third operation portion 40*bc* which receives a command of adjusting the concentration of the carbon dioxide.

When the user operates the first operation portion 40*ba*, the carbonated water preparing module 250 starts an operation and starts preparing carbonated water in the mixing container 170. When the user operates the second operation portion 40*bb*, carbon dioxide may be further supplied to the mixing container 170. In this case, according to a one-time operation of the second operation portion 40*bb*, a predetermined amount of carbon dioxide is further supplied to the mixing container 170. Also, according to the number of times the second operation portion 40*bb* is operated, a larger amount of carbon dioxide may be supplied in proportion to the number of times the second operation portion 40*bb* is operated. When the user operates the third operation portion 40*bc*, an amount of carbon dioxide used in preparing of carbonated water may be adjusted, and accordingly the concentration of carbon dioxide in carbonated water may be changed.

Each of the sections 40*a*, 40*b*, 40*c*, 40*d*, and 40*e* may be disposed according to a selection of the designer considering user's convenience. In the example shown in FIG. 23, the display section 40*a* is disposed in the center, the first operation section 40*b* is disposed below the display section 40*a*, the second operation section 40*c* is disposed below the first operation section 40*b*, and the fourth operation sections 40*d* and 40*e* are disposed on left and right sides of the display section 40*a*. However, an arrangement of the respective sections 40*a*, 40*b*, 40*c*, 40*d*, and 40*e* is not limited thereto.

The user interface 40 may be embodied by combining a plurality of layers (not shown) in which one or more symbols or letters are marked.

Hereinafter, referring to FIGS. 24 to 26, of a method of controlling a refrigerator in accordance with an embodiment will be described.

Figure 24:
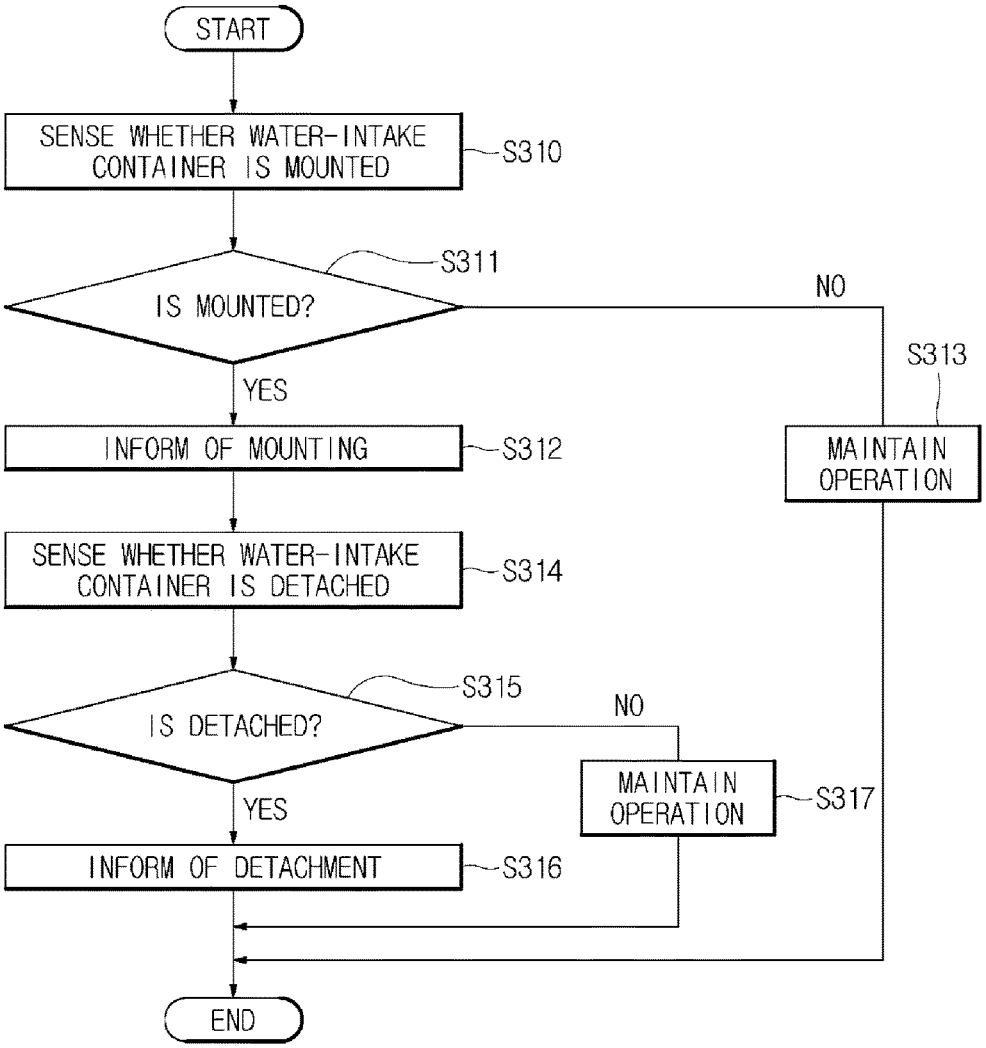
FIG. 24 is a flowchart illustrating a method of controlling a refrigerator in accordance with an embodiment of the present disclosure.

FIG. 24 is a flowchart illustrating a method of controlling a refrigerator in accordance with an embodiment of the present disclosure. FIGS. 25 and 26 are views illustrating the method of controlling the refrigerator.

As shown in FIG. 24, after the refrigerator 1 starts operating, the mounting sensor 277 senses whether the mixing container 170 is mounted on the mounting body 272 (operation S310).

Figure 25:
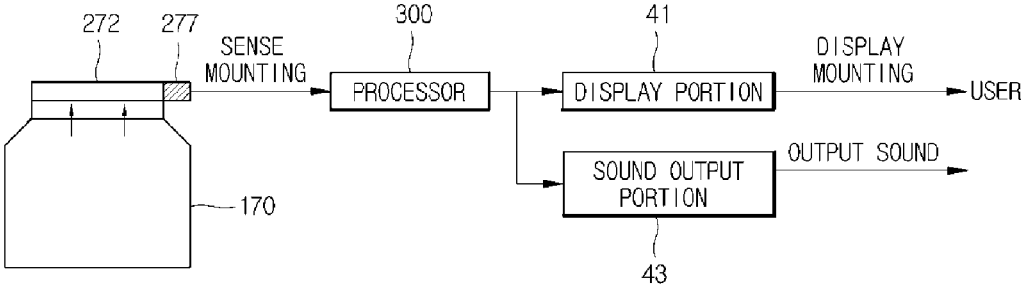
FIGS. 25 and 26 are views for explaining the method of controlling the refrigerator.
Figure 26:
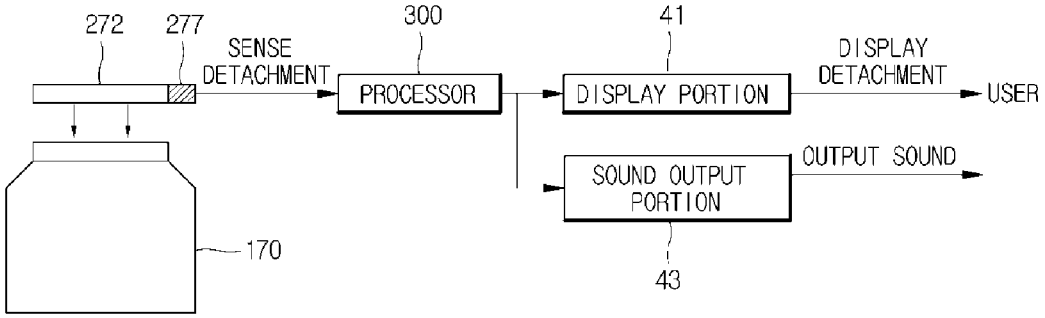

When the mixing container 170 is mounted on the mounting body 272 as shown in FIG. 25 (YES in operation S311), the mounting sensor 277 may output an electrical signal according to a sensing result, and the output electrical signal may be transmitted to the processor 300 through at least one of a circuit and a conducting wire.

The processor 300 generates a control signal corresponding to the received electrical signal and then transmits the generated control signal to at least one of the display portion 41, the lighting portion 42, and the sound output portion 43 of the user interface 40. At least one of the display portion 41, the lighting portion 42, and the sound output portion 43 which receive the control signal may display the mounting or output the received control signal to provide mounting information to the user as a sound (operation S312).

When the mixing container 170 is not mounted on the mounting body 272 (NO in operation S311), the mounting sensor 277 may not output any electrical signal, and accordingly the processor 300 may also not generate any control signal. Accordingly, the refrigerator 1 may not perform a new operation and maintains a current operation state, and the display portion 41, the lighting portion 42, and the sound output portion 43 of the user interface 40 may also continue performing operations currently underway or may maintain a state of non-operation (operation S313).

After the mixing container 170 is installed on the mounting body 272 (YES in operation S311) and after a predetermined amount of time passes, for example, after preparing carbonated water is completed, when the mixing container 170 is sensed (operation S314) to be detached from the mounting body 272 (YES in operation S315), the processor 300 may generate a control signal corresponding to a received electrical signal and may transmit the generated control signal to at least one of the display portion 41, the lighting portion 42, and the sound output portion 43 of the user interface 40. Then, at least one of the display portion 41, the lighting portion 42, and the sound output portion 43 which receive the control signal may display the detachment or output the received control signal as a sound to provide the detachment information to the user (operation S316).

When the mixing container 170 is not detached from the mounting body 272 (NO in operation S315), the mounting sensor 277 may not output any electrical signal, and accordingly the processor 300 may also not generate any control signal. Accordingly, the refrigerator 1 may not perform new additional operations and may continue performing the current operation (operation S317).

Depending on embodiments, when the mixing container 170 is not detached from the mounting body 272 for a predefined amount of time, under the control of the processor 300, at least one of the display portion 41, the lighting portion 42, and the sound output portion 43 of the user interface 40 may display a warning or output a warning sound.

Hereinafter, referring to FIG. 27, the user interface 40 provided in the refrigerator 1 and an operation of the user interface 40 in accordance with an embodiment of the present disclosure will be described.

Figure 27:
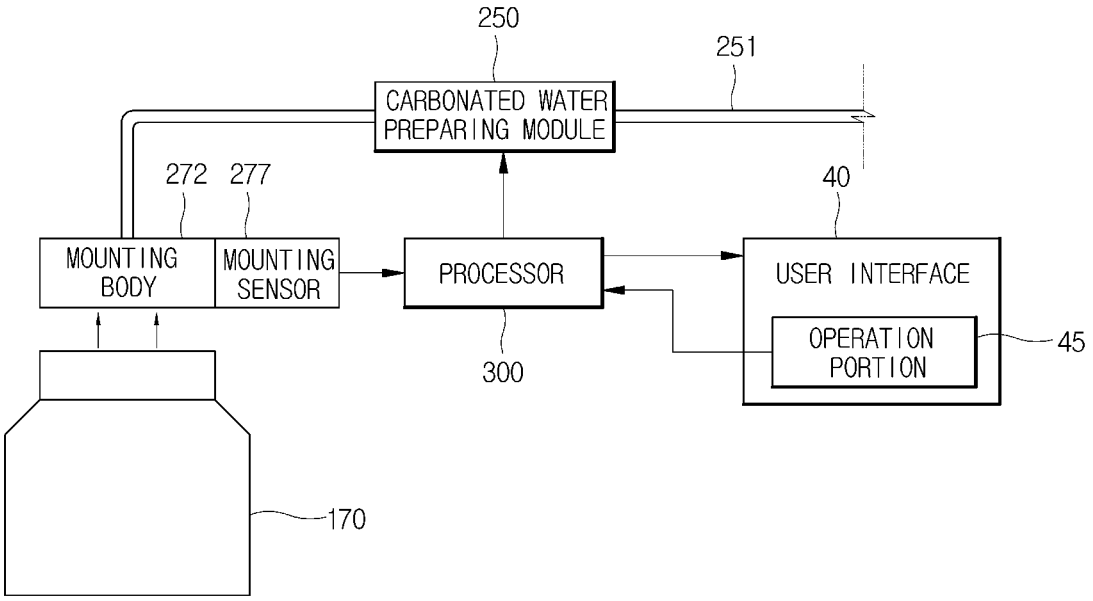
FIG. 27 is a block diagram of a refrigerator in accordance with an embodiment of the present disclosure.

FIG. 27 is a block diagram of a refrigerator in accordance with an embodiment of the present disclosure.

As shown in FIG. 27, the refrigerator 1 may include the mixing container 170 in which carbon dioxide and purified water are mixed and carbonated water is prepared, the mounting body 272 on which the mixing container 170 is mountable or detachable, the mounting sensor 277 which senses whether the mixing container 170 is mounted on the mounting body 272, the processor 300 which receives an electrical signal output from the mounting sensor 277 and generates a control signal according thereto, the user interface 40 which displays various pieces of information under the control of the processor 300 or receives a command from the user, and the carbonated water preparing module 250 which provides carbon dioxide and purified water for preparing carbonated water to the mixing container 170.

Because the mixing container 170, the mounting body 272, the mounting sensor 277, and the carbonated water preparing module 250 have already been described above, a detailed description thereof will be omitted.

In accordance with an embodiment, the processor 300 may determine whether the mixing container 170 is mounted on the mounting body 272 based on an electrical signal output by the mounting sensor 277 and may generate a control signal corresponding to the electrical signal transmitted from the operation portion 45 of the user interface 40 or may ignore the electrical signal transmitted from the operation portion 45 of the user interface 40 depending on a determination result.

In more detail, when it is determined that the mixing container 170 is mounted on the mounting body 272 according to the electrical signal output from the mounting sensor 277, the processor 300 may generate a control signal corresponding to the electrical signal received from the operation portion 45 and may control various components including the carbonated water preparing module 250, etc. by transmitting the generated control signal to the carbonated water preparing module 250, etc., thereby allowing the user to input various commands including, for example, a carbonated water preparing command using the operation portion 45. In other words, when the mixing container 170 is mounted on the mounting body 272, the processor 300 may activate an input function of the operation portion 45.

Conversely, when an electrical signal is not received from the mounting sensor 277 or an electrical signal corresponding to the detachment of the mixing container 170 such as, for example, an electrical signal according to a movement of the sensing lever 278 to the unmount position **278*b* is received from the mounting sensor 277, the processor 300 may determine that the mixing container 170 is not mounted on the mounting body 272. In this case, even though the electrical signal is transmitted from the operation portion 45, the processor 300 may not generate a control signal corresponding to the electrical signal. Accordingly, various components including the carbonated water preparing module 250, etc. are not controlled, and the user cannot input various commands such as, for example, the carbonated water preparing command using the operation portion 45. In other words, when the mixing container 170 is not mounted on the mounting body 272, the processor 300 may deactivate the input function of the operation portion 45**.

Depending on embodiments, the processor 300 may transmit a control signal to the operation portion 45 to control the operation portion 45 to output an electrical signal according to an operation of the user when it is determined that the mixing container 170 is mounted on the mounting body 272 and may transmit a control signal to the operation portion 45 to control the operation portion 45 not to output an electrical signal even when an operation of the user is applied to the operation portion 45 when, on the contrary, the mixing container 170 is not mounted on the mounting body 272. Accordingly, the operation portion 45 may be activated or deactivated depending on whether the mixing container 170 is mounted.

As described above, because the operation portion 45 is activated or deactivated depending on whether the mixing container 170 is mounted, the carbonated water preparing module 250 is prevented from operating to prepare carbonated water when the mixing container 170 is not mounted, thereby preventing an accident caused by a mal-operation by the user.

Meanwhile, as described with reference to FIG. 23, at least one of the first operation portion **40*ba*, the second operation portion 40*bb*, and the third operation portion 40*bc* may be provided in the first operation section 40*b*. Under the control of the processor 300 described above, at least one of the first operation portion 40*ba*, the second operation portion 40*bb*, and the third operation portion 40*bc* may be operable only when the mixing container 170 is mounted on the mounting body 272**.

In addition, because the processor 300 and the user interface 40 have already been described with reference to FIG. 20, a detailed description thereof will be omitted.

Figure 28:
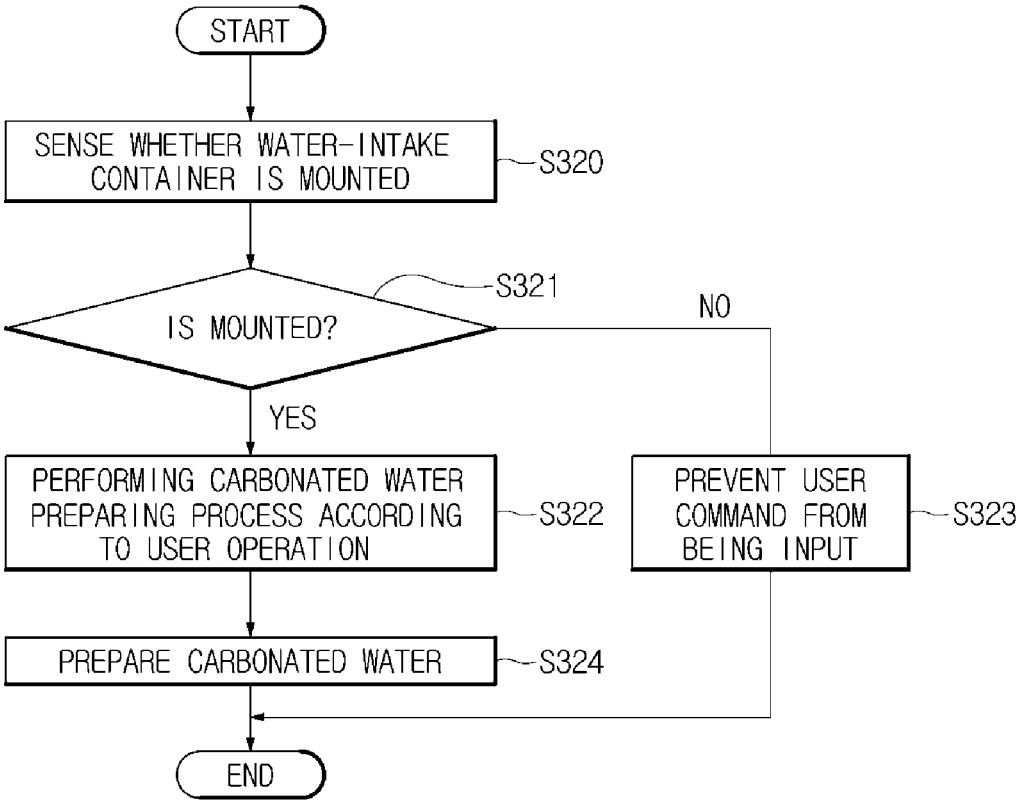
FIG. 28 is a flowchart illustrating a method of controlling a refrigerator in accordance with an embodiment of the present disclosure.

FIG. 28 is a flowchart illustrating a method of controlling a refrigerator in accordance with an embodiment of the present disclosure.

According to the method of controlling the refrigerator in accordance with an embodiment shown in FIG. 28, first, whether the mixing container 170 is mounted on the mounting body 272 is sensed (operation S320).

When the mixing container 170 is mounted on the mounting body 272 (YES in operation S321), the user may input various commands related to preparing carbonated water through the operation portion 45 (operation S322). For example, the user may request the refrigerator 1 to prepare carbonated water, may supply a larger amount of carbon dioxide into the carbonated water, or may control the concentration of the carbon dioxide in the carbonated water by operating the first operation portion 40*ba*, the second operation portion 40*bb*, or the third operation portion 40*bc*.

As described above, the user may input various commands related to the preparing of carbonated water through the operation portion 45, thereby preparing carbonated water according to an operation of the user (operation S324).

When the mixing container 170 is not mounted on the mounting body 272 (NO in S321), even though the user operates the operation portion 45, it is impossible to input various commands related to preparing carbonated water (operation S323). Accordingly, when the mixing container 170 is not mounted on the mounting body 272, it is possible to prevent an unintended operation of the carbonated water preparing module 250.

As is apparent from the above description, a refrigerator and a method of controlling the same in accordance with an embodiment of the present disclosure may improve convenience of users by allowing users to easily determine whether a mixing container is fastened to a carbonated water preparing module in case of using the refrigerator capable of preparing and supplying carbonated water by fastening the mixing container to the carbonated water preparing module.

The refrigerator and the method of controlling the same in accordance with an embodiment of the present disclosure may prevent various accidents or damages of users which may occur when a carbonated water preparing process is performed while the mixing container is not fastened, thereby improving safety of users in using the refrigerator.

Accordingly, users may more safely and stably get carbonated water using the refrigerator capable of preparing and supplying the carbonated water and thus may more conveniently use the refrigerator.

Although a few embodiments of the present disclosure have been shown and described, it would be appreciated by those skilled in the art that changes may be prepared in these embodiments without departing from the principles and spirit of the disclosure, the scope of which is defined in the claims and their equivalents.

What is claimed is:

1. A refrigerator comprising:

a mounting body configured to receive a mixing container, which is detachable from the mounting body of the refrigerator, in which carbon dioxide and water are mixed to produce carbonated water;

a first dispenser assembly configured to inject the carbon dioxide and the water into the mixing container when the mixing container is mounted on the mounting body;

a user interface configured to output information regarding whether the mixing container is mounted on the mounting body; and a processor configured to control the user interface, wherein the user interface further comprises an operation portion configured to receive a user's operation, wherein the processor is further configured to activate or deactivate the operation portion based on whether the mixing container is mounted on the mounting body, so that when the mixing container is mounted on the mounting body, the operation portion is activated while the user interface outputs the mixing container is mounted on the mounting body, and when the mixing container is not mounted on the mounting body, the operation portion is deactivated while the user interface outputs the mixing container is not mounted on the mounting body, wherein the mixing container comprises one or more mounting protrusions, the mounting body comprises a sensing lever to be turned according to a pressure applied by the one or more mounting protrusions when the mixing container is mounted to the mounting body, and a sensor portion configured to sense turning of the sensing lever, and wherein the processor is further configured to determine whether the mixing container is mounted on the mounting body based on the sensed turning of the sensing lever.

2. The refrigerator of claim 1, wherein the user interface comprises at least one of:

a display portion configured to display the information regarding whether the mixing container is mounted on the mounting body as an image, a lighting portion configured to emit light depending on whether the mixing container is mounted on the mounting body, a sound output portion configured to output a sound depending on whether the mixing container is mounted on the mounting body, and a touch screen portion configured to receive a touch operation.

3. The refrigerator of claim 1, wherein the information indicates that the mixing container is mounted when the mixing container is mounted on the mounting body.

4. The refrigerator of claim 1, wherein the information indicates that the mixing container is detached when the mixing container is detached from the mounting body.

5. The refrigerator of claim 1, wherein the user interface further comprises a lighting portion for the operation portion which is disposed on at least one of the operation portion and the periphery of the operation portion and is configured to emit light depending on whether the mixing container is mounted on the mounting body.

6. The refrigerator of claim 1, further comprising a second dispenser assembly configured to dispense at least one of water and ice when the mixing container is detached from the mounting body.

7. A refrigerator comprising:

a mounting body configured to receive a mixing container, which is detachable from the mounting body of the refrigerator and includes one or more mounting protrusions, in which carbon dioxide and water are mixed to produce carbonated water;

a first dispenser assembly configured to inject the carbon dioxide and the water into the mixing container when the mixing container is mounted on the mounting body;

an operation portion configured to receive a command for controlling the first dispenser assembly while the mixing container is mounted on the mounting body; and a processor configured to activate or deactivate the operation portion based on whether the mixing container is mounted on the mounting body, so that when the mixing container is mounted on the mounting body, the operation portion is activated to receive commands, and when the mixing container is not mounted on the mounting body, the operation portion is deactivated to prevent commands from being input to the operation portion, wherein the mounting body comprises:

a sensing lever to be turned according to a pressure applied by the one or more mounting protrusions; and a sensor portion configured to sense turning of the sensing lever, and the processor is further configured to determine whether the mixing container is mounted on the mounting body based on the sensed turning of the sensing lever.

8. The refrigerator of claim 7, wherein the operation portion comprises at least one of:

a first operation portion configured to receive a command to start the production of the carbonated water, a second operation portion configured to receive a command to add the carbon dioxide, and a third operation portion configured to receive a command to adjust a concentration of the carbon dioxide.

9. A method of controlling a refrigerator which includes a first dispenser assembly configured to inject carbon dioxide and water into a mixing container, the method comprising:

turning a sensing lever of a mounting body according to a pressure applied by one or more mounting protrusions of the mixing container, wherein the mixing container is detachable from the mounting body, in which the carbon dioxide and the water are mixed to produce carbonated water;

sensing, by a sensor portion of the mounting body, the turning of the sensing lever;

determining whether the mixing container is mounted on the mounting body of the refrigerator based on a result of the sensing;

outputting, by a user interface including a display portion configured to display information and an operation portion configured to receive a user's operation regarding the refrigerator, the information on the display portion regarding whether the mixing container is mounted on the mounting body;

activating the operation portion when the mixing container is mounted on the mounting body to receive commands by the operation portion; and deactivating the operation portion when the mixing container is not mounted on the mounting body to disable commands to the operation portion.

10. The method of claim 9, wherein the outputting, by the user interface, of the information regarding whether the mixing container is mounted on the mounting body comprises at least one of:

displaying the information regarding whether the mixing container is mounted on the mounting body as an image, emitting light, by a lighting portion, depending on whether the mixing container is mounted on the mounting body, outputting a sound depending on whether the mixing container is mounted on the mounting body, and receiving, by a touch screen portion, a touch operation.

11. The method of claim 9, wherein the information indicates that the mixing container is mounted on the mounting body.

12. The method of claim 9, wherein the information indicates that the mixing container is detached from the mounting body.

13. The method of claim 9, wherein the user further interface a lighting portion for the operation portion disposed on at least one of the operation portion and the periphery of the operation portion.

14. The method of claim 13, further comprising emitting light by the lighting portion for the operation portion depending on whether the mixing container is mounted on the mounting body.

15. The method of claim 9, further comprising producing the carbonated water by injecting the carbon dioxide and the water into the mixing container when the mixing container is coupled with the mounting body.

* * * * *